US006581289B2

(12) United States Patent
Nakano

(10) Patent No.: US 6,581,289 B2
(45) Date of Patent: Jun. 24, 2003

(54) INNER CUTTER FOR AN ELECTRIC ROTARY SHAVER AND AN ELECTRIC ROTARY SHAVER

(75) Inventor: Tsuyoshi Nakano, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 09/912,894

(22) Filed: Jul. 25, 2001

(65) Prior Publication Data

US 2002/0017022 A1 Feb. 14, 2002

(30) Foreign Application Priority Data

Jul. 25, 2000 (JP) ..... 2000-223914

(51) Int. Cl.[7] ..... B26B 19/16
(52) U.S. Cl. ..... 30/43.6; 30/346.51
(58) Field of Search ..... 30/43.4, 43.5, 30/43.6, 346.51

(56) References Cited

U.S. PATENT DOCUMENTS 3,125,808 A * 3/1964 Starre ..... 30/43.6
4,329,781 A * 5/1982 Schemmann et al. ..... 30/43.6
4,343,086 A * 8/1982 de Vries et al. ..... 30/43.6
4,729,169 A * 3/1988 Asawa ..... 30/346.51

FOREIGN PATENT DOCUMENTS

| | | |
|---|---|---|
| DE | 1 010 864 | 6/1957 |
| EP | 0 885 696 | 12/1998 |
| EP | 1 063 066 | 12/2000 |

* cited by examiner

*Primary Examiner*—Hwei-Siu Payer
(74) *Attorney, Agent, or Firm*—Koda & Androlia

(57) ABSTRACT

An inner cutter for an electric rotary shaver, the inner cutter comprising a cutter supporting member and an inner cutter body. The cutter supporting member has a ring-form body formed in a shape of a flat plate and is provided with a plurality of upright supporting portions that rise from an outer-circumferential edge of the ring-form body and are lined up side by side. The inner cutter body is formed on the tip end of each one of the upright supporting portions. Gaps are formed between adjacent upright supporting portions, and ribs are provided between the adjacent upright supporting portions, thus allowing cut hair to be discharged out of the inner cutter through openings defined by the adjacent upright supporting portions and ribs.

12 Claims, 8 Drawing Sheets

INNER CUTTER FOR AN ELECTRIC ROTARY SHAVER AND AN ELECTRIC ROTARY SHAVER

BACKGROUND OF THE INVENTION

1. Field of the Invention

The present invention relates to an inner cutter for an electric rotary shaver and to a rotary type electric shaver.

2. Prior Art

A conventional electric rotary shaver will be described with reference to FIGS. 7 and 8.

First, to describe the overall structure, the electric shaver 10 is substantially comprised of a main body case 16 and a cutter head section 24. The main body case 16 is made of a synthetic resin and is held in hand of the user when hair, beard, mustache, etc. (called "hair") is shaved. The main body case 16 contains, along with other components, a motor 12, a power supply switch 14 and a power supply part (not shown) that supplies electric power to the motor 12. The cutter head section 24 is detachably mounted on the upper end of the main body case 16 and has outer cutters 18, inner cutters 20 and inner cutter bases 22 for the inner cutters 20, etc. that are built into the cutter head section 24.

FIGS. 7 and 8 show an electric shaver 10 in which three outer cutters 18 are installed in the cutter head section 24 so that the centers of three outer cutters 18 are positioned substantially at the vertices of an equilateral triangle. However, there are no restrictions on the number of outer cutters 18. The outer cutters 18 (and the corresponding inner cutters 20) can be one, two or four or more.

Inner cutter drive shafts 28 made of a synthetic resin are installed so as to protrude (in a number equal to the number of inner cutters 20) from a cutter cradle 26 that covers the opening part in the upper portion of the main body case 16. The inner cutter drive shafts 28 transmit the rotational force of the motor 12 to the inner cutters 20 installed in the cutter head section 24. When the cutter head section 24 is mounted on the main body case 16 (or more specifically attached to the cutter cradle 26 of the main body case 16), the tip ends of the inner cutter drive shafts 28 are connected by an interlocking engagement to the inner cutter bases 22 to which the inner cutters 20 are attached. Also, the inner cutters 20 receive a rotational force from the inner cutter drive shafts 28 and rotate as a unit with the inner cutter drive shafts 28.

Next, the structures of the respective components of the electric shaver will be described in detail.

First, the cutter head section 24 is comprised of a cutter frame 30 made of a synthetic resin, outer cutters 18 made of metal, an outer cutter holder 32 which is made of a synthetic resin and holds the outer cutters 18, inner cutters 20 made of metal, inner cutter bases 22 which are made of a synthetic resin and to which the inner cutters 20 are attached, and a cutter retaining plate 34 which is made of a synthetic resin and which holds the inner cutters 20 so that the inner cutters 20 are rotatable.

The metal outer cutters 18 are formed so that the overall shape of the outer cutters 18 is a shape derived by inverting a cylindrical body which has a bottom and which has a low height (i.e., an inverted dish shape or cap shape). An annular outside hair introduction region V, and an annular inside hair introduction region W positioned to the inside of the outside hair introduction region V, are formed concentrically in the upper-surface portion of each outer cutter 18 which contacts the skin.

Furthermore, a positioning engaging portion 36 (as one example in the shape of a recess) is formed in the under-surface of the region X located within the inside hair introduction region W of each outer cutter 18. The positioning engaging portion 36 prevents wobbling of the rotational axis of each inner cutter 20 with respect to the corresponding outer cutter 18 by engaging in an interlocking manner with the end portion of the corresponding inner cutter base (described later), so that each inner cutter 20 constantly rotates coaxially with the corresponding outer cutter 18

A plurality of hair introduction openings 40 are opened in the inside and outside hair introduction regions V and W. In FIG. 7, the hair introduction openings are formed as slits that extend from the outer side to the inner side of the respective hair introduction regions V and W. Scattered small holes having a round shape, oval shape or slot-form shape may be used as the hair introduction openings 40.

Furthermore, the surfaces of the respective hair introduction regions V and W are formed as flat surfaces; in the case of the outer cutter 18 shown in FIG. 8, the respective hair introduction regions V and W are formed (as one example) so that they are positioned in the same plane.

Each one of these outer cutters 18 is mounted in a corresponding outer cutter holder 32 made of a synthetic resin so that: the outer cutter 18 is not rotatable, the amount of protrusion of the outer cutter 18 form the outer cutter holder 32 can be altered, and the outer cutter 18 is tiltable in all directions within a specified angular range inside the outer cutter holder 32.

Furthermore, the outer cutters 18 are mounted together with the outer cutter holder 32 in the cutter frame 30 so that the tip ends of the outer cutters 18 protruded from outer cutter holes 42 formed in the cutter frame 30. Since the internal diameter of the outer cutter holes 42 is formed so that it is slightly larger than the external diameter of the outer cutters 18, the outer cutters 18 are mounted in the cutter frame 30 so that the amount of protrusion of the outer cutters from the cutter frame 30 can be varied by the movement of the outer cutters 18 along the axial lines of the outer cutter hole 42, and so that the outer cutters 18 can be tilted in all directions with respect to the axial lines of the outer cutter holes 42 within a specified angular range.

As shown in FIGS. 8 and 9, the metal outer cutter 20 is comprised of a cutter supporting member 21 and a plurality of inner cutter bodies 23. The cutter supporting member 21 has a ring-form body 21*a*, which is formed in the shape of a flat plate, and a plurality of upright supporting portions 21*b*. The upright supporting portions 21*b* are raised from the outer-circumferential edge of the ring-form body 21*a* and are lined up side by side at equal angular intervals. The inner cutter bodies 23 are formed on the tip ends of the respective upright supporting portions 21*b*.

The root portions of the adjacent upright supporting portions 21*b* on the side of the ring-form body 21*a* are connected to each other within a specified height range Y from the surface of the ring-form body 21*a* so that the overall shape is formed as a cylindrical shape. Accordingly, the bottom surface portion of each inner cutter 20 is constructed in the shape of a dish by the root portions of the respective upright supporting portions 21*b* formed into a cylindrical shape, and the ring-form body 21*a*.

Furthermore, the inner cutter bodies 23 are integrally connected to the inclined surfaces of the upper portions or the respective upright supporting portions 21*b* (which are formed with a triangular shape, as one example) so that the inner cutter bodies 23 protrude to the outside of the corresponding inner cutter 20. The tip ends of the inner cutter bodies 23 are formed with a bifurcated shape, so that the overall shape of the inner cutter bodies 23 is a U shape or Y shape. Of the bifurcated tip ends of each inner cutter body 23, the tip end on the outer-circumferential side contacts the inside surface of the outside hair introduction region V of the corresponding outer cutter 18, while the tip end on the inner-circumferential side contacts the inside surface of the inside hair introduction region W of the corresponding outer cutter 18. When the outer cutters 20 rotate, the respective tip ends of the respective inner cutter bodies 23 rotate while making sliding contact with the inside surfaces of the respective hair introduction regions V and W of the corresponding outer cutters 18.

Furthermore, the inner cutters 20 are attached to the inner cutter bases 22 by the insertion of the tip ends of the inner cutter bases 22 into opening parts opened in the bottom surfaces of the ring-form bodies 21*a* of the inner cutters 20. Accordingly, these opening parts of the inner cutters 20 are closed off by the inner cutter bases 22.

The cutter retaining plate 34 is a component that holds the inner cutters 20; this cutter retaining plate is formed from a synthetic resin material, and is constructed from attachment rings 34*a* that are equal in number to the inner cutters 20, and a supporting frame 34*b* which connects these attachment rings 34*a* into an integral unit. Furthermore, anchoring portions 48 protrude toward the axial lines of the attachment rings 34*a* from the inner-circumferential surfaces of the attachment rings 34*a*. Furthermore, an attachment screw 50 which is used to attach the cutter retaining plate 34 to the cutter frame 30 is disposed in the center of the cutter retaining plate 34.

The structure by which the inner cutters 20 are held by the cutter retaining plate 34 will be described.

The inner cutter bases 22 to which the inner cutters 20 are fastened are formed in a columnar shape from a synthetic resin material. An inner cutter 20 is fastened to one end portion (the upper end portion in FIG. 8) of each inner cutter base 22, and a flange part 52 is formed on the outer-circumferential surface of the other end portion (the lower end portion in FIG. 8) of each inner cutter base 22. Furthermore, a positioning engaged portion 38 (as one example, this part is formed as an engaging projection) which engages with a positioning engaging portion 36 formed in the center of the corresponding outer cutter 18 is formed in the center of the first end portion of each inner cutter base 22. Moreover, the radius of the flange parts 52 of the inner cutter bases 22 is greater than the distance from the axial lines (centers) of the attachment rings 34*a* to the inside tip ends of the anchoring portions 48 formed on the inner-circumferential surfaces of the attachment rings 34*a*, and the radius of the parts of the inner cutter bases 22 other than the flange parts 52 is smaller than the distance from the axial lines of the attachment rings 34*a* to the inside tip ends of the anchoring portions 48. Furthermore, engaging recesses 56 in which engaging projections 54 formed on the tip ends of the inner cutter drive shafts 28 are engaged are formed in the end surfaces of the second end portions of the inner cutter bases 22.

Furthermore, when the inner cutters 20 are fastened to the inner cutter bases 22, the ring-form bodies 21*a* of the inner cutters 20 are first fastened to the first end portions of the inner cutter bases 22, and the inner cutters 20 are fastened to the inner cutter bases 22. As a result, the positioning engaged portions 38 protrude from the insides of the ring-form bodies 21*a*.

Afterward, the inner cutter bases 22 are inserted into the attachment rings 34*a* of the cutter retaining plate 34 from the other end portions of the inner cutter bases 22. In this case, the anchoring portions 48 of the attachment rings 34*a* and the flange parts 52 of the inner cutter bases 22 interfere with each other; however, the anchoring portions 48 are caused to bend slightly, thus allowing the insertion of the flange parts 52 into the attachment rings 34*a*.

As a result, the inner cutters 20, whose radii are greater than the distance from the axial lines of the attachment rings 34*a* to the inside tip ends of the anchoring portions 48, and the flange parts 52 of the inner cutter bases 22, are positioned on both sides of the attachment rings 34*a* with the attachment rings 34*a* clamped between these parts. Accordingly, the inner cutters 20 are held in the attachment rings 34*a* so that the inner cutters 22 are prevented from slipping out. Furthermore, the inner cutters 22 are held so that they are rotatable inside the attachment rings 34*a*, and so that they are tiltable in all directions with respect to the axial lines of the attachment rings 34*a* and free to slide in the direction of these axial lines.

Next, the structure used to attach the outer cutters 18 and inner cutters 20 to the cutter frame 30 will be described.

First, the outer cutter holder 32 to which the outer cutters 18 are attached is mounted in the cutter frame 30. Afterward, the cutter retaining plate 34 holding the inner cutters 20 is attached to the cutter frame 30 by screwing an attachment screw 50 into a female screw hole 30*a* formed in the inside surface of the cutter frame 30. As a result, the outer cutter holder 32 is pressed by the cutter retaining plate 34 so that the outer cutters 18 and inner cutters 20 are attached to the cutter frame 30 in a manner that prevents these cutters from slipping out.

Furthermore, if the attachment screw 50 is turned in the reverse direction, the inner cutters 20 can be removed from the cutter frame 30 as an integral unit with the cutter retaining plate 34, and the outer cutters 18 can be removed from the cutter frame 30 as an integral unit with the outer cutter holder 32.

Next, the main body case 16 in which the inner cutter drive shafts 28 are disposed will be described.

The main body case 16 is formed in the shape of a cylinder with a bottom, which is open at the top. A motor 12, a battery (not shown) and a control circuit, etc., are contained inside this main body case 16.

A gear bearing plate 58 is disposed inside the main body case 16 near the edge of the opening of the main body case 16. The motor 12 is fastened to this gear bearing plate 58 at right angles in a state in which the output shaft 12*a* of the motor 12 is caused to protrude. Furthermore, supporting shafts 60 are fastened in place adjacent to the output shaft 12*a* and parallel to the output shaft 12*a* in positions corresponding to the outer cutters 18. Moreover, a motor gear 62 is attached to the output shaft 12*a*, and inner cutter driving gears 64 made of a synthetic resin are attached to the supporting shafts 60 so that these inner cutter driving gears 64 are rotatable, and so that the gears 64 engage with the motor gear 62. Cylindrical cover portions 65 which cover the supporting shafts 60 that are passed through the inner cutter driving gears 64 are disposed in upright positions as integral parts of the inner cutter driving gears 64 on the central portions of the upper surfaces of the inner cutter driving gears 64, and shaft anchoring portions 70 are formed so that these shaft anchoring portions 70 surround the cover portions 65.

Furthermore, a cutter cradle 26 which closes off the opening part at the upper end of the main body case 16 is positioned above the gear bearing plate 58 in the opening part. Drive shaft holes 66 are formed in this cutter cradle 26 coaxially with the respective supporting shafts 60 on the axial lines of the supporting shafts 60.

The inner cutter drive shafts 28 are disposed so that the tip ends of these inner cutter drive shafts 28 protrude from the drive shaft holes 66. A plurality of engaging projections 68 are formed on the outer-circumferential surfaces of the lower ends of the inner cutter drive shafts 28, and these engaging projections 68 respectively engage with the plurality of shaft anchoring portions 70 that are formed on the upper surfaces of the inner cutter driving gears 64 so that these anchoring portions 70 surround the lower parts of the inner cutter drive shafts 28.

More specifically, the inner cutter drive shafts 28 are provided so that: the inner cutter drive shafts 28 rotate as an integral unit with the inner cutter driving gears 64, the inner cutter drive shafts 28 tilt in all directions with respect to the axial lines of the inner cutter driving gears 64 (which are also the axial lines of the supporting shafts 60), and the inner cutter drive shafts 28 move a specified distance along these axial lines.

Engaging projections 54 are formed on the closed upper ends of the inner cutter drive shafts 28, and the lower ends of these inner cutter drive shafts 28 are formed as open cylindrical bodies. The cover portions 65 formed on the inner cutter driving gears 64 are inserted into the interiors of the inner cutter drive shafts 28 from these opening parts at the lower ends of the inner cutter drive shafts 28.

Furthermore, coil springs 72 are disposed inside the inner cutter drive shafts 28 so that the coil springs 72 are fitted over the cover portions 65. These coil springs 72 are disposed so that they are compressed between the inside upper surfaces of the inner cutter drive shafts 28 and the upper surfaces of the inner cutter driving gears 64; accordingly, the inner cutter drive shafts 28 are constantly driven upward with respect to the inner cutter driving gears 64. The inner cutter drive shafts 28 are driven by the coil springs 72 in a direction that causes the inner cutter drive shafts 28 to move away from the inner cutter driving gears 64. However, when the inner cutter drive shafts 28 are away from the inner cutter driving gears 64 by a specified distance, the engaging projections 68 formed on the outer-circumferential surfaces of the lower ends of the inner cutter drive shafts 28 engage with the shaft anchoring portions 70 formed on the upper surfaces of the inner cutter driving gears 64. Accordingly, the inner cutter driving gears 64 do not slip off of the cover portions 65.

With the above-described structures of the cutter head section 24 and main body case 16, when the cutter head section 24 is attached to the main body case 16, the engaging projections 54 formed on the tip ends of the inner cutter drive shafts 28 are inserted into the engaging recesses 56 formed in the lower end surfaces of the inner cutter bases 22. Furthermore, the inner cutter drive shafts 28 are pressed against the inner cutter bases 22. Thus, the inner cutter drive shafts 28 are pushed slightly into the interior of the cutter cradle 26 against the driving force of the coil springs 72.

In this state, the driving force of the coil springs 72 is transmitted to the inner cutters 20 from the inner cutter drive shafts 28 via the inner cutter bases 22, so that the inner cutters 20 are pushed toward the outer cutters 18. As a result, the tip ends of the inner cutter bodies 23 of the inner cutters 20 contact tightly to the inner-circumferential surfaces of the outer cutters 18, and the outer cutters 18 are pushed by the inner cutters 20 so that the outer cutters show a maximum protrusion from the cutter frame 30.

Then, when the electric shaver 10 is used to shave hair, the main body case 16 is held in the hand, and the outer cutters 18 that protrude from the surface of the cutter frame 30 are contacted to the skin. In this case, the outer cutters 18 move into the interior of the cutter frame 30 against the driving force of the coil springs 72 and the elastic force of the cutter retaining plate 34 (i.e., the amount of protrusion of the outer cutters 18 from the cutter frame 30 changes), or the outer cutters 18 tilt appropriately, in accordance with the contour of the skin. As a result, the respective hair introduction regions V and W formed in the outer cutters 18 are maintained in tight contact with the skin.

Even in cases where the outer cutters 18 tilt with respect to the cutter frame 30, the positioning engaged portions 38 formed on the end portions of the inner cutter bases 22 are engaged in an interlocking manner with the positioning engaging portions formed on the outer cutters 18. Accordingly, the inner cutters 20 also tilt in accordance with the tilting of the outer cutters 18. Thus, the respective tip ends of the inner cutter bodies 23 of the inner cutters 20 are kept in tight contact with the inside surfaces of the respective hair introduction regions V and W of the outer cutters 18.

The hair cut by the inner cutters 20 and outer cutters 18 working together are taken into the insides of the outer cutters 18 and fall downward through the rotating regions of the inner cutter bodies 23. Ultimately, the hair accumulates on the surface of the synthetic resin cutter cradle 26 which is attached so that it covers the opening part formed in the upper portion of the main body case 16.

However, the hair that has been cut is very fine. Thus, not all of hair falls downward through the rotating regions of the inner cutter bodies 23. In many cases, the hair is caused to advance toward the center, i.e., into the internal regions of the inner cutters 20, by the eddy-form air currents that are generated inside the outer cutters 18 by the rotation of the inner cutters 20. The hair that has thus entered the internal regions of the inner utters 20 move toward the bottom portions of the internal cutters 20. However, the structure of the bottom portion of each inner cutter 20 is constructed as described above in the form of a dish by the root portions of the respective upright supporting portions 21*b* that are formed into a cylindrical shape as a result of being connected to the ring-form body 21*a*. Thus, the hair has no avenue of escape. As a result, hair 73 accumulate on the inside bottom surfaces of the inner cutters 20 (i.e., on the upper surface of the ring-form bodies 21*a*, and especially in the corner areas with the upright supporting portions 21*b* on the outer-circumferential edge as shown in FIG. 9C). Furthermore, unlike the upper surface of the cutter cradle 26, which is inherently set so that hair will accumulate, the insides of the inner cutters 20 in which the hair accumulates are not designed for ease of cleaning. Thus, it is difficult to clean away the hair in the inner cutters 20.

SUMMARY OF THE INVENTION

Accordingly, the object of the present invention is to solve the above-described problems in the prior art inner cutters in electric rotary shavers.

More specifically, the object of the present invention is to provide an inner cutter for an electric rotary shaver, as well as an electric shaver, which prevents the accumulation of hair, beard, mustache, etc. (referred to as "hair") inside the inner cutter even if shaved hair should advance into the interiors of the inner cutter.

The above object is accomplished by a unique structure for an electric shaver and particularly for an inner cutter for an electric shave, in which the inner cutter comprises:

a cutter supporting member that has a ring-form body formed in a shape of a flat plate and a plurality of upright supporting portions which rise from an outer-circumferential edge of the ring-form body and are lined up side by side; and an inner cutter body that is formed on the tip end of each one of the upright supporting portions, wherein the upright supporting portions are formed with gaps between adjacent upright supporting portions, and the adjacent upright supporting portions are connected to each other by ribs at positions that are away from the ring-form body.

As a result, even if shaved hair advance into the interior of the inner cutter and fall on the surface of the ring-form body, the hair can escape to outside of the inner cutter via the gaps between adjacent upright supporting portions, and more particularly, via the gaps defined by the ribs, the adjacent upright supporting portions and the outer edge of the ring-form body. Accordingly, the cut hair is prevented from accumulating inside the inner cutter.

In the above structure, in each of the upright supporting portions, the width of the lower half thereof is formed smaller than the width of the upper half thereof. In other words, a part of each upright supporting portion that is located on one side (lower side) of a position where the ribs are joined and is closer to the ring-form body is smaller than the width of a part of each upright supporting portion which is located on another side (upper side) of the position where the ribs are joined and is closer to the inner cutter body.

With this structure, the gaps through which the hair escape increase size-wise, and the cut hair is more easily discharged and even less likely to accumulate inside the inner cutter.

Furthermore, the inner cutter is formed by stamping and bending a single flat metal plate, and each of the ribs is bent outward from a central portion thereof so as to have a V shape.

As a result, the inner cutter is manufactured by pressing, and the manufacturing cost can be reduced.

The above described object is further accomplished by a unique structure of the present invention for an electric rotary shaver that comprises:

a main body case that contains an electric motor, and a cutter head section that is detachably mounted on an upper portion of the main body case, the cutter head section including outer cutters and inner cutters that shave hair in cooperation with the outer cutters while rotating in sliding contact with the outer cutters, wherein each of the inner cutters is comprised of:

a cutter supporting member that has a ring-form body formed in a shape of a flat plate and a plurality of upright supporting portions which rise from an outer-circumferential edge of the ring-form body and are lined up side by side; and an inner cutter body that is formed on tip end of each one of the upright supporting portions, wherein the upright supporting portions are formed with gaps between adjacent upright supporting portions, and adjacent upright supporting portions are connected to each other by ribs at positions that are away from the ring-form body.

The above described object is further accomplished by another unique structure of the present invention for an electric rotary shaver that comprises:

inside outer cutters;

cylindrical outside outer cutters which surround the inside outer cutters in a concentric configuration, the cylindrical outside outer cutters being mounted inside a cutter frame so that tip ends of the outside outer cutters protrude together with the inside outer cutters from outer cutter holes formed in the cutter frame;

inside inner cutters that make a sliding contact with the inside outer cutters; and outside inner cutters that make a sliding contact with the outside outer cutters, wherein each of the outside inner cutters is comprised of:

a cutter supporting member that has a ring-form body formed in a shape of a flat plate and a plurality of upright supporting portions which rise from an outer-circumferential edge of the ring-form body and are lined up side by side, and an inner cutter body that is formed on tip end of each one of the upright supporting portions, wherein the upright supporting portions are formed with gaps between adjacent upright supporting portions, and adjacent upright supporting portions are connected to each other by ribs at positions that are away from the ring-form body;

the outside outer cutters are provided inside the cutter frame so that the outside outer cutters are tiltable with respect to axial lines of the outer cutter holes and movable along the axial lines, and the inside outer cutters are connected to the outside outer cutters so that the inside outer cutters are tiltable with respect to axial lines of the outside outer cutters and movable along the axial lines;

the inside inner cutters are engaged with the inside outer cutters so that the inside inner cutters are rotatable in a state in which the axial lines of the inside inner cutters and the inside outer cutters constantly coincide; and the outside inner cutters are engaged with the outside outer cutters so that the outside inner cutters are rotatable in a state in which the axial lines of both cutters constantly coincide.

DETAILED DESCRIPTION OF THE INVENTION

Figure 1:
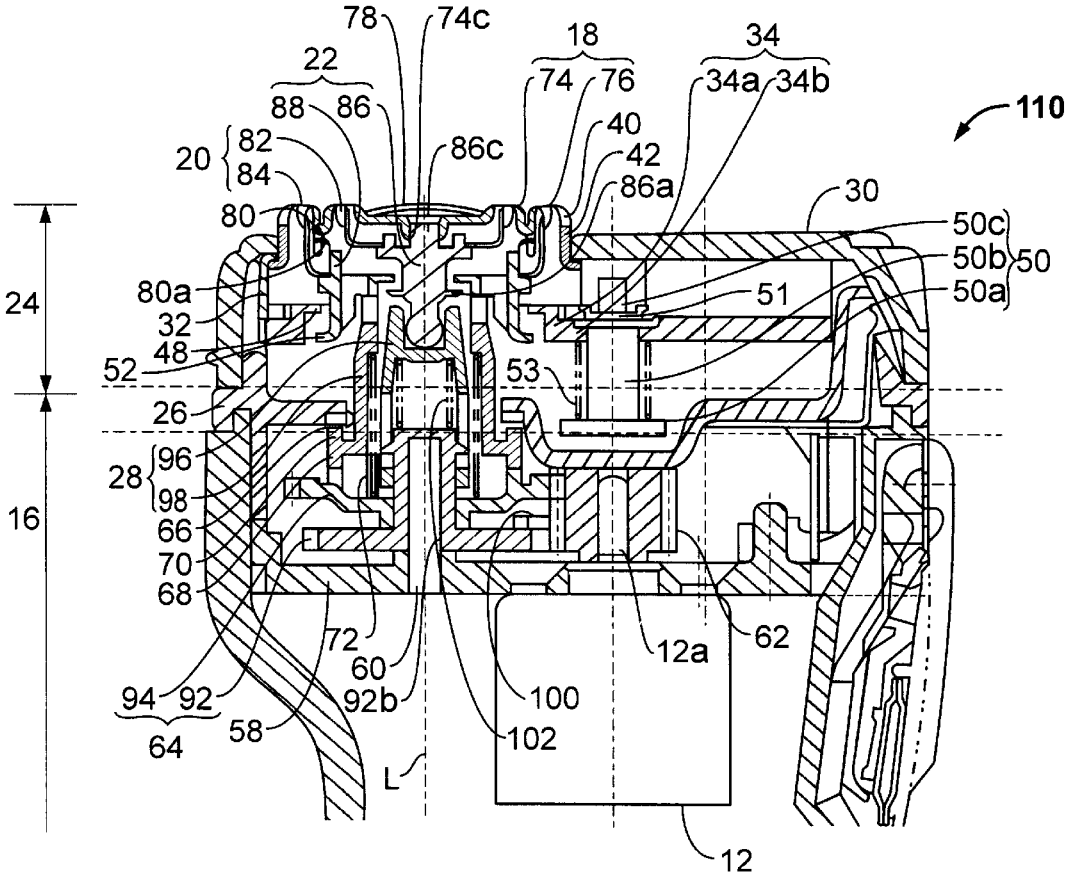
FIG. 1 is a sectional view of the essential portion of the internal structure of the cutter head section of the electric shaver according to the present invention.

Preferred embodiments of the present invention will be described in detail below with reference to the accompanying drawings. Structures that are the same as those of the conventional electric rotary shaver 10 are labeled with the same reference numerals, and a detailed description of such structures will be omitted.

Figure 7:
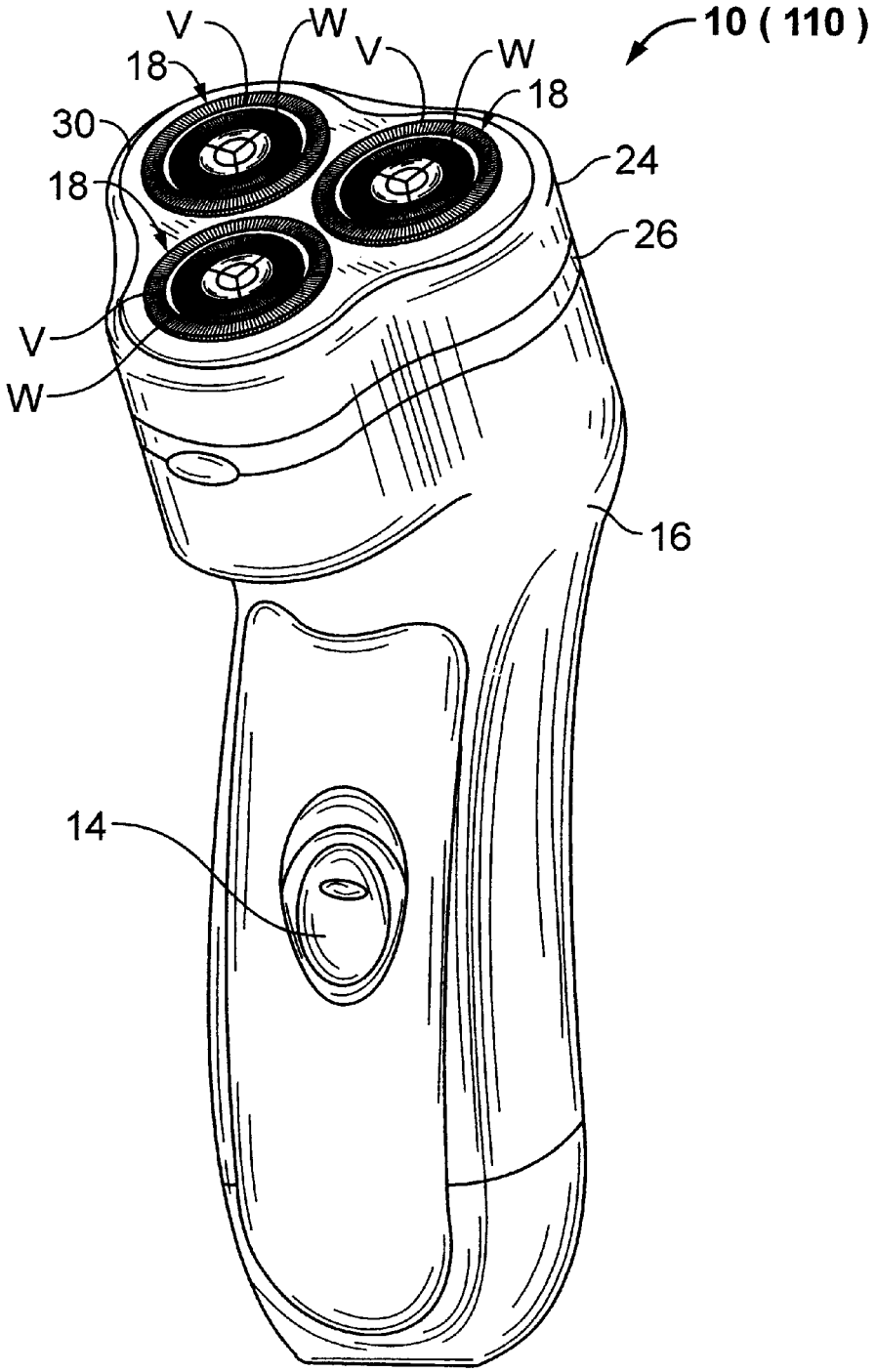
FIG. 7 PRIOR ART
FIG. 7 is a perspective view of the external appearance of a conventional electric shaver.
Figure 8:
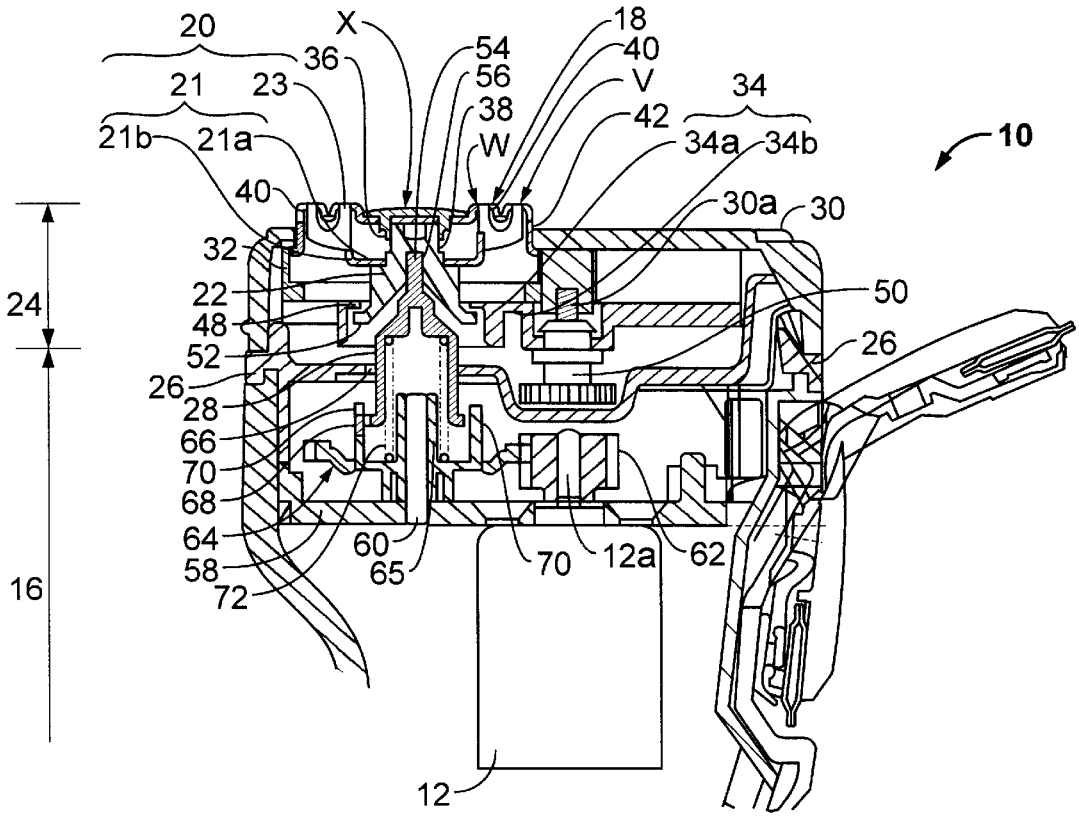
FIG. 8 PRIOR ART
FIG. 8 is a sectional view of the essential portion of the internal structure of the cutter head section of a conventional electric shaver.

First, the overall external appearance of the electric rotary shaver of the present embodiment is substantially the same as that of the conventional electric rotary shaver shown in FIG. 7. However, the internal structures of the shaver of the present invention are different from those of the conventional shaver. Accordingly, the structure of the electric rotary shaver of the present invention will be described with reference to FIG. 7 used in the description of the conventional shaver, along with FIG. 1.

The electric shaver 110 is constructed from a main body case 16, and a cutter head section 24 which is detachably mounted on the upper portion of this main body case 16, and which contains outer cutters 18 and inner cutters 20, etc. Furthermore, in the present embodiment, an electric shaver 110 in which three outer cutters 18 (and the same number of inner cutters 20) are installed in the cutter head section 24 as shown in FIG. 7 is described as an example. However, the number of outer cutters 18 is not limited to three; it goes without saying that the present invention can also be applied in cases where the number of outer cutters 18 is one, two or four or more outer cutters.

Furthermore, the inner cutter drive shafts 28 that are used to transmit the rotational force of the motor 12 to the inner cutters 20 of the cutter head section 24 protrude (in a number equal to the number of inner cutters 20) from the cutter cradle 26 attached to the upper portion of the main body case 16. Moreover, when the cutter head section 24 is attached to the main body case 16, the inner cutter bases 22 to which the inner cutters 20 are fastened and the tip ends of the inner cutter drive shafts 28 are engaged, thus forming a structure that allows the inner cutters 20 to rotate as an integral unit with the inner cutter drive shafts 28. This basic structure is the same as that of the conventional example.

Next, the respective structures of the present embodiment that differ from the structures of the above-described conventional example will be described with reference to FIGS. 1 through 6.

First, the cutter head section 24 will be described.

The cutter head section 24 is comprised of a cutter frame 30, outer cutters 18, an outer cutter holder 32 in which the outer cutters 18 are mounted, inner cutters 20, inner cutter bases 22 to which the inner cutters 20 are attached, and a holding plate 34 which holes the inner cutters 20 so that the inner cutters 20 are rotatable.

Furthermore, the outer cutters 18 are each constructed from two independent components, i.e., an inside outer cutter 74 and a substantially cylindrical outside outer cutter 76. The outside outer cutter 76 is mounted inside the cutter frame 30 so that the outside outer cutter 76 concentrically surrounds the inside outer cutter 74. Also, the tip end of the outside outer cutter 76 is set to protrude along with the inside outer cutter 74 from an outer cutter hole 42 formed in the cutter frame 30.

Moreover, in conformity to the structure of the outer cutters 18, the inner cutters 20 are also each constructed from two independent components, i.e., an inside inner cutter 82 and an outside inner cutter 84. The inside inner cutter 82 rotates while making sliding contact with the corresponding inside outer cutter 74. The outside inner cutter 84 rotates while making sliding contact with the corresponding outside outer cutter 76.

The above-described structures will be described in greater detail in regard to the structure of the outer cutters and the structure of the inner cutters.

The Structure of the Outer Cutters 76

Figure 2:
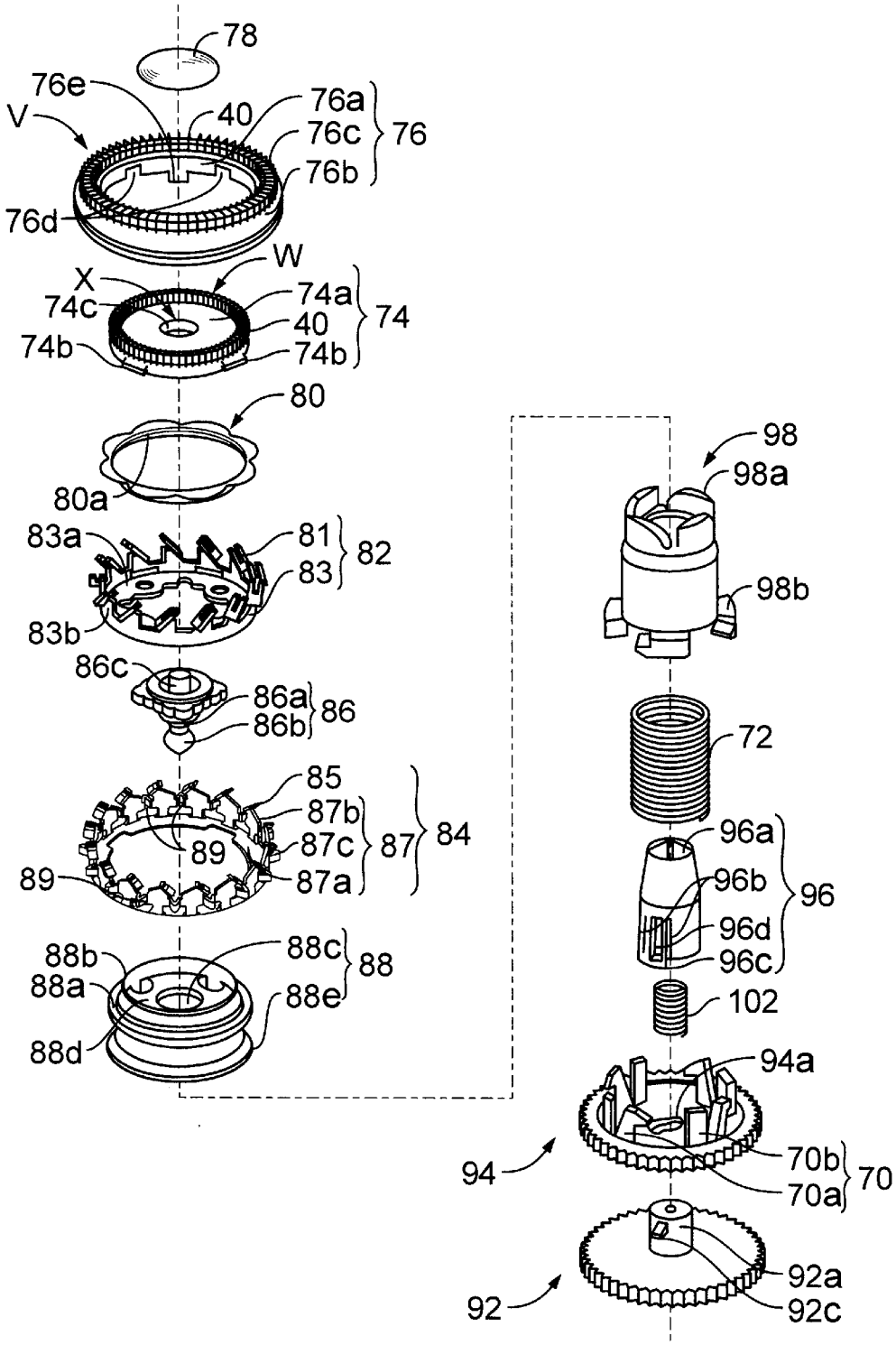
FIG. 2 is an exploded perspective view of the outer cutter, the inner cutter and the driving system for such cutters.

Each outside outer cutter 76 is formed in such a manner that, as shown in FIG. 2, the respective end surfaces (located at one end, i.e., the upper end surfaces in FIG. 2) of an inner cylindrical body 76*a* and an outer cylindrical body 76*b* are connected by an annular plate body 76*c*. The inner cylindrical body 76*a* and the outer cylindrical body 76*b* are disposed concentrically (coaxially) and continuously. An outside hair introduction region V is formed in this plate body 76*c*. The hair introduction openings 40 of the outside hair introduction region V is formed (as one example) in the form of slits that extend in a substantially radial configuration. However, as in the conventional example, the shape of the hair introduction openings is not limited to a slit shape.

Furthermore, a plurality of cut-outs 76*d* which extend along the axial line of the inner cylindrical body 76*a* and which reach the other end surface (i.e., the lower end surface in FIG. 2) of the inner cylindrical body 76*a* are formed in the inner cylindrical body 76*a*. Similarly, furthermore, a plurality of positioning extended portions 76*e* are formed in this other end surface of the inner cylindrical body 76*a* in positions where the cut-outs 76*d* are not formed.

A fastening ring member 80 is a part of each outside outer cutter 76. The fastening ring member 80 is fastened between the positioning extended portions 76*e* on the lower part of the inner cylindrical body 76*a* so that the cut-outs 76*d* are closed off. The fastening ring member 80 connects each inner cutter 20 to the corresponding outer cutter 18. The inner-circumferential side of the fastening ring member 80 is formed with a cylindrical shape. This cylindrical part 80*a* and the tip end part of an outside inner cutter base (described later) are engaged so that the corresponding outside inner cutter 84 can rotate with the axial line of the outside inner cutter 84 coinciding with the axial line of the outside outer cutter 76. Furthermore, in the engagement relationship of the above embodiment, the tip end portion is inserted and engaged in the cylindrical part 80*a*. However, it is also possible to reverse this structure. In other words, an engagement relationship in which the cylindrical part 80*a* is inserted and engaged in the tip end portions of the outside inner cutter bases is possible.

The positioning extended portions 76*e* are formed so as to function as a positioning means for the fastening ring members 80.

Each one of the inside outer cutters 74 is formed with an overall shape of an inverted dish (in other words, a cap shape). The inside outer cutter 74 is lower in height than the corresponding outside outer cutter 76 and has an external diameter that is slightly smaller than the internal diameter of the cylindrical body 76*a* of the outside outer cutter 76. The inside hair introduction region W is formed on the outer edge portion of the upper surface 74*a* of each inside outer cutter 74. As one example, the hair introduction openings 40 of the inside hair introduction region W are formed as slits that extend substantially in the radial direction.

Furthermore, connecting projections 74*b* which are equal in number to the cut-outs 76*d* formed in the cylindrical body 76*a* of each outer cutter 18 are caused to protrude from the outer-circumferential surface of each inside outer cutter 74 at positions corresponding to the cut-outs 76*d*. The width of the connecting projections 74*b* in the circumferential direction is smaller than the width of the cut-outs 76*d* in the circumferential direction. Thus, inside the outside outer cutter 76, the inside outer cutter 74 is tiltable in all directions and is moved inward and outward with respect to the outside outer cutter 76. But, the relative rotation of the inner and outer cutters is restrained when the connecting projections 74*b* is entered the cut-outs 76*d* so that the outside outer cutter 76 and inside outer cutter 74 are connected.

Furthermore, a positioning extended portion 74*c* (as one example, the positioning extended portion 74*c* is formed as cylindrical engaging recesses) is formed in the central portion of the upper surface 74*a* of the inside outer cutter 74. The positioning extended portion 74*c* engages with positioning engaged portion formed on the inside inner cutter base (described later) and causes the axial line of the inside inner cutter attached to the inside inner cutter base to coincide with the axial line of the inside outer cutter 74.

In FIG. 2, the reference numeral 78 is a cover which is mounted in the center of the upper surface 74*a* of the inside outer cutter 74 so that the cover covers the positioning extended portions 74*c*.

The inside outer cutters 74 are connected to the outside outer cutters 76 as follows: First, the inside outer cutters 74 are inserted into the inner cylindrical bodies 76*a* of the outside outer cutters 76 while engaging the respective connecting projections 74*b* inside the respective cut-outs 76*d*. Afterward, the fastening ring members 80 are installed between the positioning extended portions 76*e* of the outside outer cutters 76. Then, the outer-circumferential edges of the fastening ring members 80 are welded to the other end surfaces of the inner cylindrical bodies 76*a* of the outside outer cutters 76. Thus, the fastening ring members 80 are fastened to the outside outer cutters 76, and the open end portions of the cut-outs 76*d* are closed off.

The above fastening is performed with the axial lines of the inner cylindrical bodies 76*a* and the axial lines of the fastening ring members 80 being caused to coincide.

As a result, the outside outer cutters 76 and inside outer cutters 74 are connected so that they are prevented from separation and from relative rotation.

Inside the outside outer cutters 76, the inside outer cutter 74 is movable along the axial lines of the outside outer cutters 76. In other words, each inside outer cutter 74 is movable between the position in which the inside hair introduction region W protrudes with respect to the outside hair introduction region V and the position in which the inside hair introduction region W is recessed with respect to the outside hair introduction region V.

Moreover, the outer cutters 18 which are formed by connecting the outside outer cutters 76 and inside outer cutters 74 into integral units are mounted in the synthetic resin outer cutter holder 32. In the outer cutter holder 32, as in the conventional outer cutters, the outer cutters 18 are restrained from rotating; also the outer cutters 18 is movable within a specified range along the corresponding axial line and is tiltable within a specified range with respect to the axial line.

The outer cutters 18 are mounted inside the cutter frame 30 together with the outer cutter holder 32 so that the tip ends of the outer cutters 18 protrude from the outer cutter holes 42 formed in the cutter frame 30. The outside outer cutters 76 of the mounted outer cutters 18 are movable along the axial lines of the outer cutter holes 42 with respect to the cutter frame 30 and are tiltable in all directions about these axial lines. Also, the inside outer cutters 74 are movable along the axial lines of the outside outer cutters 76 with respect to the outside outer cutters 76 and are tiltable in all directions about these axial lines.

Structure of Inner Cutters

The inner cutters 20 and inner cutter bases 22 are also respectively constructed from two independent components in conformity to the structure of the outer cutters 18, thus being different from the conventional inner cutters.

In other words, each inner cutter 20 is constructed from two independent components, i.e., the inside inner cutter 82 and the outside inner cutter 84. Furthermore, corresponding to these respective inner cutters 82 and 84, the inner cutter base 22 to which the inner cutters 20 are attached is also constructed from two components, i.e., an inside inner cutter base 86 and an outside inner cutter base 88.

The detailed structures of the respective constituting elements of the inner cutter will be described below.

First, the inside inner cutter 82 is comprised of a plurality of inside inner cutter bodies 81 and a ring-form inside inner cutter supporting member 83. The inside inner cutter bodies 81 are provided on inside inner cutter supporting member 83. The inside inner cutter bodies 81 are arranged circumferentially at equal intervals in a single row so as to correspond to the inside hair introduction regions W of the inside outer cutters 74. The basic structure of the inner cutter is the same as that of the conventional inner cutter.

More specifically, the inside inner cutter supporting member 83 is comprised of an inside ring-form body 83*a* which is formed as a flat plate and a plurality of inside upright supporting portions 83*b* which rise from the outer-circumferential edge of this inside ring-form body 83*a*. The inside upright supporting portions 83*b* are formed side by side at equal angular intervals. The root portions of the adjacent inside upright supporting portions 83*b* on the side of the inside ring-form body 83*a* are connected to each other so as to be in a cylindrical shape. Accordingly, the bottom-surface portion of each inside inner cutter 82 is constructed in a dish shape by the root portions of the inside upright supporting portions 83*b* and inside ring-form body 83*a* of a cylindrical shape.

Next, the outside inner cutters 84, which constitute a characterizing feature of the present invention, will be described in detail.

Each outside inner cutter 84 is formed so that a plurality of upright outside outer cutter bodies 85 are supported by a ring-form outside inner cutter supporting member 87 which is the cutter supporting member of the present invention. The outside outer cutter bodies 85 are disposed at equal angular intervals in a single row on the circumference of the same circle (in accordance with the outside hair introduction region V).

Each outside inner cutter supporting member 87 is comprised of an outside ring-form body 87*a*, a plurality of outside upright supporting portions 87*b*, and ribs 87*c*. The outside upright supporting portions 87*b* are formed so as to rise from the outer-circumferential edge of the outside ring-form body 87*a*, and they are lined up side by side at equal angular intervals. The ribs 87*c* connect the adjacent outside upright supporting portions 87*b* to each other.

Figure 6A:
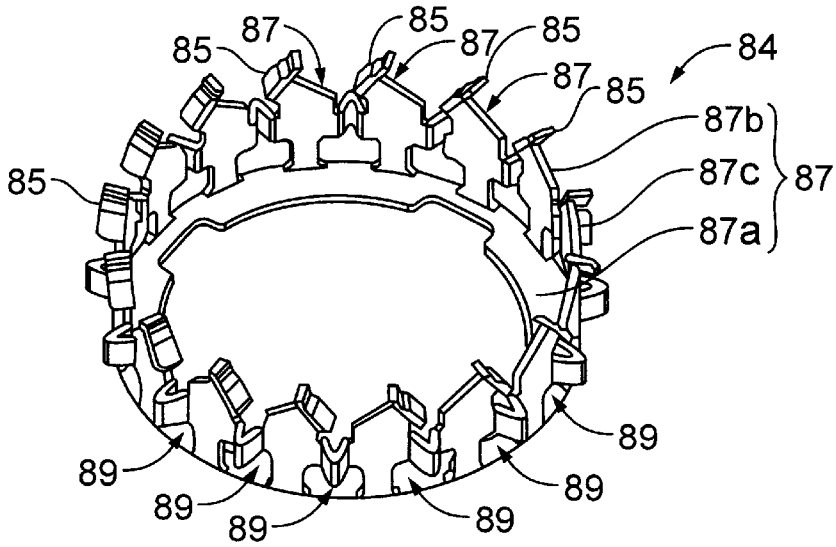
FIG. 6A is a perspective view of one of the outside inner cutters of one embodiment of the present invention.
Figure 6B:
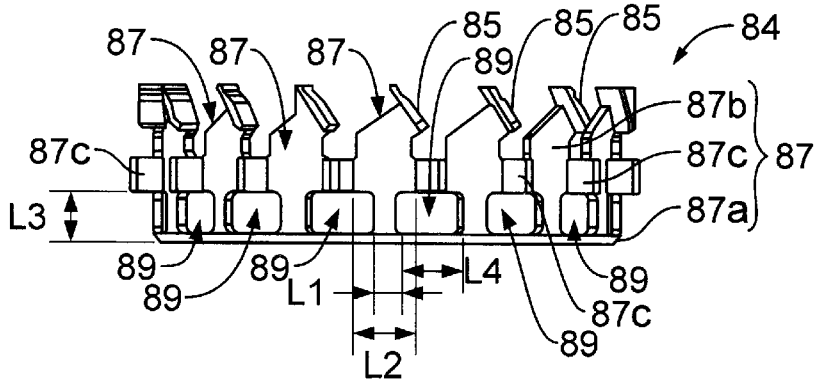
FIG. 6B is a front view thereof.
Figure 6C:
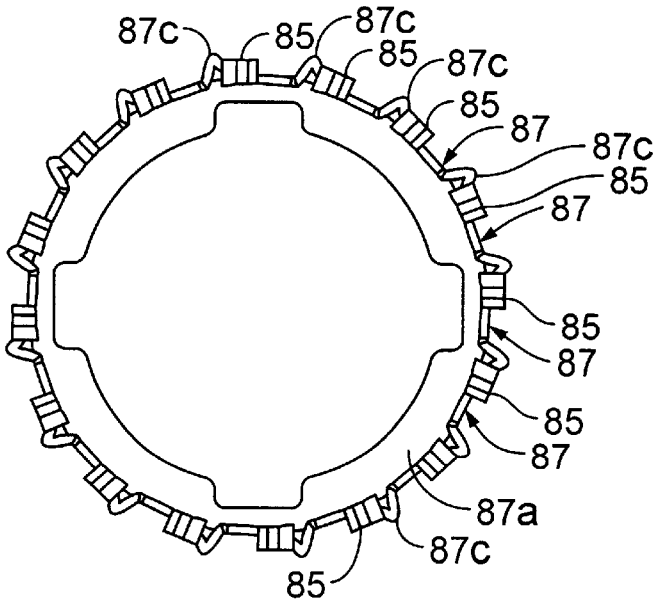
FIG. 6C is a plan view thereof.

More specifically, as seen from FIG. 6A, each outside upright supporting portion 87*b* is formed so that it is separated from other adjacent outside upright supporting portions 87*b*, thus creating gaps between the adjacent outside upright supporting portions 87*b*. In other words, the root portions of the outside upright supporting portion 87*b* are not continuous to each other as in the upright supporting portions 21*b* of the conventional inner cutter 20.

Furthermore, the adjacent outside upright supporting portions 87*b* are connected to each other and reinforced by ribs 87*c* at positions that are away from the outside ring-form body 87*a*. Accordingly, the outside inner cutter 84 of the present invention differs from the inner cutter 20 of the conventional inner cutter in that hair discharge openings 89 are formed at equal angular intervals along the outer-circumferential edge of the outside ring-form body 87*a*. The edges of each hair discharge opening 89 is formed by the outer edge of the outside ring-form body 87*a*, the facing side surfaces of adjacent outside upright supporting portions 87*b*, and the undersurface of the rib 87*c*. In other words, the hair discharge opening 89 is defined by the outer edge of the outside ring-form body 87*a*, by the facing side surfaces of adjacent outside upright supporting portions 87*b*, and by the undersurface of the rib 87*c*.

Accordingly, even if hair should enter the interiors of the outside inner cutter 84, the hair is discharged to the outside of the outside inner cutter 84 via the hair discharge openings 89. Thus, hair is prevented from accumulating inside the outside inner cutter 84. Furthermore, the outside upright supporting portions 87*b* are connected to each other by the ribs 87*c* and thus reinforced. Accordingly, the thickness of the outside upright supporting portions 87*b* can be reduced; and as a result, the weight of the inner cutter 20 can be reduced.

Considering the strength of the outside upright supporting portions 87*b*, it is desirable that the positions, where the ribs 87*c* are connected to the outside upright supporting portions 87*b*, be as close as possible to the tip ends of the outside upright supporting portions 87*b* to which the outside inner cutter bodies 85 (to which an external force is applied when hair is cut) are attached. In other words, it is desirable that the positions of the ribs 87*c* be as high as possible on the outside upright supporting portions 87*b*. Thus, the positions of the ribs 87*c* are set at higher positions, and the ribs 87*c* are provided at positions that are away from the upper surface of the outside ring-form body 87*a*. As a result, the opening height L3 of the hair discharge openings 89 is increased, thus increasing the efficiency of discharging of the hair, while the strength of the outside upright supporting portions 87*b* is secured.

Furthermore, each outside upright supporting portion 87*b* is set so that the width L1 of the outside ring-form body (87*a*) side of the position where the rib 87*c* is provided is smaller than the width L2 of the outside inner cutter body (85) side of the position where the rib 87*c* is provided. In other words, in each of the outside upright supporting portions 87*b*, the width L1 of the lower half or the lower side is smaller than the width L2 of the upper half or the upper side. With this width design of each outside upright supporting portion 87*b*, the opening width L4 of the hair discharge opening 89 increases while the strength of the outside upright supporting portion 87*b* is ensured. Thus, the discharge of hair to the outside from the interior of the outside inner cutter 84 is accomplished efficiently. Since the lower end of the respective outside upright supporting portions 87*b* that are connected by the ribs 87*c* is located between the ribs 87*c* and the outside ring-form body 87*a*, a sufficient strength is assured for each outside upright supporting portion 87*b* even if the width L1 is narrow.

Each rib 87*c* is bent outward from its central portion so that the rib 87*c* has a V-shaped cross section. The V-shape rib is obtained as described below. When the outside outer cutter 84 is manufactured, a flat metal plate is used. First the flat metal plate is stamped so that the outside ring-form body 87*a*, the plurality of outside inner cutter supporting members 87 that extend radially from the outer edge of the outside ring-form body 87*a*, the outside inner cutter bodies 85 that are connected to the tip ends of these outside inner cutter supporting members 87 and the plurality of ribs 87*c* that connect the respective outside inner cutter supporting members 87 to each other are formed in a flat attitude. Then, bending is applied to the respective outside inner cutter supporting members 87 so that the outside inner cutter supporting members 87 are bent approximately 90 degrees on the same side of the outside ring-form body 87*a*. When this bending is applied, the ribs 87*c* with an extra length are bent into a V shape.

Since each of the outside inner cutters 84 is manufactured from a single flat metal plate by pressing and bending, the cost of manufacture is reduced.

Structure of Inner Cutter Base

The inside inner cutter base 86 is formed in a columnar shape from a synthetic resin material. An inside inner cutter 82 is attached to one end portion (the upper end portion in FIG. 2) of each inside inner cutter base 86. Furthermore, a positioning engaged portion 86*c* (as one example, this part is formed as an engaging projection) which engages with a positioning engaging portion 74*c* (as one example, this part is formed as an engaging recess) formed in the corresponding inside outer cutter 74 and causes the axis of rotation (axial line) of the inside inner cutter base 86 to coincide with the axial line of the inside outer cutter 74 is formed in the upper end surface of the inside inner cutter base 86 (which passes through the corresponding inside inner cutter 82).

Furthermore, locking parts 86*a* are caused to protrude radially from the outer-circumferential surface of the intermediate portion of each inside inner cutter base 86. Moreover, a bump portion 86*b* whose maximum-diameter portion has a non-circular cross-sectional shape in the direction perpendicular to the axial line of the inside inner cutter base 86 (in the present embodiment, as one example, this shape is a polygonal shape such as a square shape, etc.) is formed on the other end portion (i.e., the lower end portion in FIG. 2) of each inside inner cutter base 86. Furthermore, the lower end surface of this bump portion 86*b* is formed as a protruding curved surface (e.g., a hemispherical surface). This bump portion 86*b* is accommodated in a connecting recess formed in the corresponding inside drive shaft (described later), thus connecting the inside inner cutter base 86 and the inside drive shaft so that these parts can rotate as a unit, and so that the inside inner cutter base 86 can tilt in all directions with respect to the axial line of the inside drive shaft. In other words, the bump portion 86 and the connecting recess form a universal joint. Furthermore, it would also be possible to use a reverse structure in which the bump portion 86*b* is formed on the side of the inside drive shaft and the connecting recess is formed on the side of the inside inner cutter base.

The outside inner cutter bases 88 are formed as cylindrical bodies from a synthetic resin material. An outside inner cutter 84 is fitted over one end portion (the upper end portion in FIG. 2) of each outside inner cutter base 88. The outside inner cutter 84 that is thus fitted over this end portion is attached to a fastening flange part 88*a* that is formed on the outer-circumferential surface on the side of this end portion. The tip end 88*b* of one end portion of the corresponding outside inner cutter base 88 that is positioned on the inside of the ring-form outside inner cutter 84 is inserted into and engaged with the cylindrical part 80*a* of the fastening ring member 80 of the corresponding outside outer cutter 76. As a result, the outside inner cutter base 88 is supported so that the outside inner cutter base 88 is rotatable, and so that the axial line of the outside inner cutter base 88, i.e., the axial line of the outside inner cutter 84, constantly coincides with the axial line of the corresponding outside outer cutter 76. Accordingly, there is no wobbling of the rotational axis of the outside inner cutter 84 inside the outside outer cutter 76.

Furthermore, a disk-form member 88*d* in the center of which a base insertion hole 88*c* used for the inside inner cutter base 86 is opened is formed in the inner-circumferential surface on the side of one end portion of each outside inner cutter base 88. The radius of this base insertion hole 88*c* is set so that it is slightly smaller than the distance from the axial line of the inside inner cutter base 86 to the tip ends of the locking parts 86*a*. Furthermore, a locking flange part 88*e* is formed on the outer-circumferential surface of the other end portion (i.e., the lower end portion in FIG. 2) of the outside inner cutter 84. The external diameter of the fastening flange part 88*a* in the present embodiment is set so that it is substantially the same as the external diameter of the locking flange part 88*e*. In concrete terms, the diameters of the respective flange parts 88*a* and 88*e* are set so that they are slightly larger than the distance from the center of the attachment ring 34*a* to the tip ends of the anchoring portions 48.

Structure of Cutter Retaining Plate

As in the conventional example, the inner cutters 20 of the present embodiment are mounted and held in attachment rings 34*a* formed in a cutter retaining plate 34.

Here, the cutter retaining plate 34 is formed from a synthetic resin material. The structure in which a number of attachment rings 34*a* equal to the number of inner cutters 20 and disposed in positions corresponding to the positions of the inner cutters 20 are connected by a supporting frame 34*b* is the same as in the conventional example. Furthermore, the structure in which anchoring portions 48 are caused to protrude from the inner-circumferential surfaces of the respective attachment rings 34*a* is also the same as in the conventional example. Moreover, the shown embodiment is similar to the conventional shaver in that an attachment screw 50 is disposed in the center of the cutter retaining plate 34.

The structure of the supporting frame 34*b* of the cutter retaining plate 34 of the this embodiment will be detailed with reference to FIG. 4, which shows the shape of the cutter retaining plate 34 in a plan view, and FIG. 1, which shows the internal structure of the cutter head section 24.

As one example, the supporting frame 34*b* is constructed by integrally connecting three U-shaped members in a Y configuration in a state in which the open sides of the U-shaped members face outward. Furthermore, the attachment screw 50 is constructed from a head part 50*a*, a columnar part 50*b* which forms a continuation of this head part 50*a*, and a small-diameter screw part 50*c* which protrudes from the tip end of this columnar part 50*b*. The columnar part 50*b* is passed through the central portion of the supporting frame 34*b*. Furthermore, a C-ring 51, etc. are fitted over the root portion of the screw part 50*c*, so that the attachment screw 50 can rotate relative to the supporting frame 34*b*, but is prevented from falling out of the supporting frame 34*b*. Furthermore, as shown in FIG. 1, a coil spring 53 is fitted over the columnar part 50*b* of the attachment screw, so that the supporting frame 34*b* is constantly driven toward the ring with the head part 50*a* of the attachment screw 50 as a reference. As a result of this structure, the supporting frame 34*b* tightly contact to the C-ring in a state in which no external force is applied to the supporting frame 34*b*. However, when the supporting frame 34*b* is pushed toward the head part 50*a* of the attachment screw 50 by a uniform force in opposition to the driving force of the coil spring 53, the supporting frame 34*b* moves toward the head part 50*a* of the attachment screw 50 along the columnar part 50*b* of the attachment screw 50; furthermore, in cases where the force that is applied is not uniform, the supporting frame 34*b* tilts with respect to the axial line of the attachment screw 50.

Furthermore, attachment rings 34*a* are disposed inside the respective U-shaped members of the supporting frame 34*b*, and as one example, the attachment rings 34*a* and U-shaped members are connected at three points.

Figure 4:
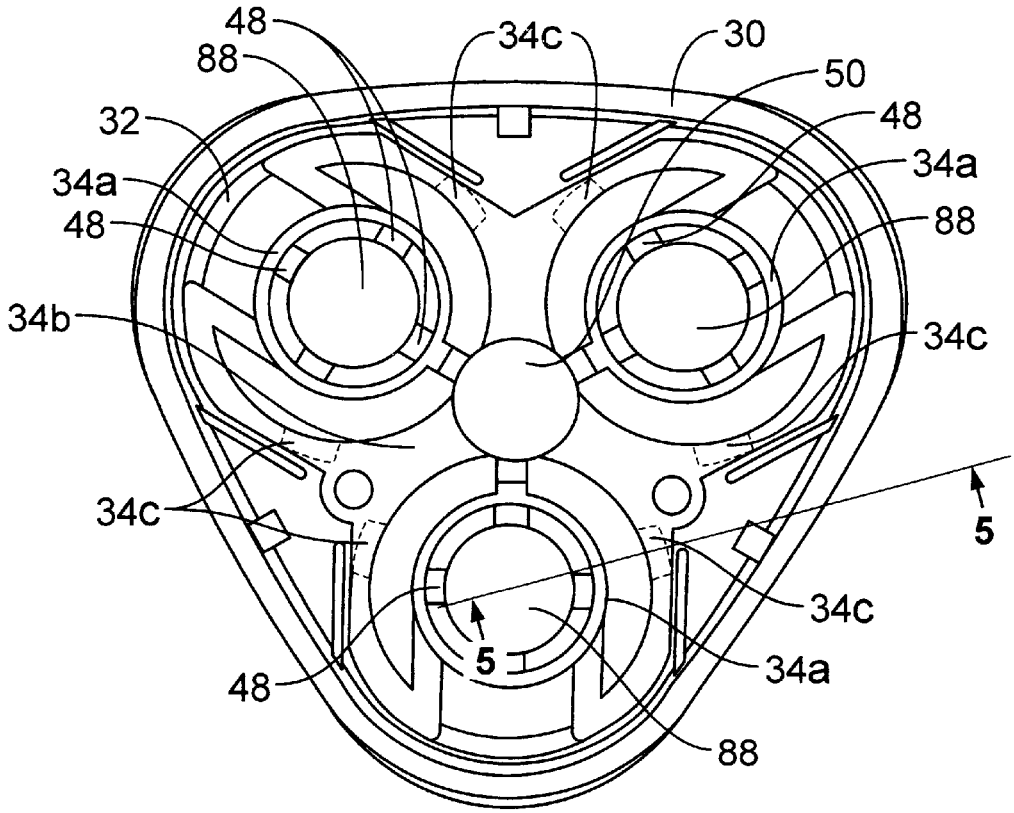
FIG. 4 is a bottom view of the cutter head section.
Figure 5:
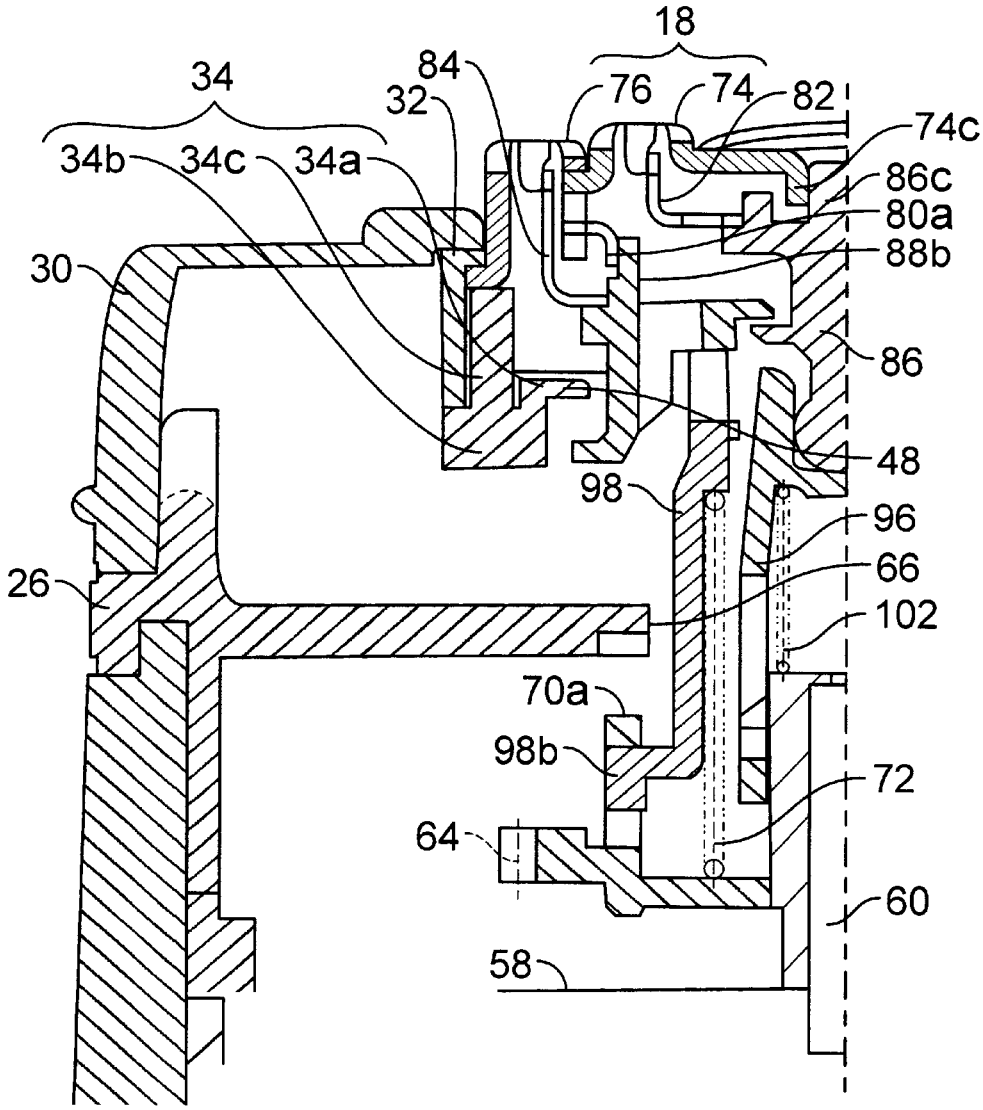
FIG. 5 is a sectional view taken along the line 5—5 in FIG. 4, in which the cutter head section is mounted on the main body case.

Furthermore, as shown in FIGS. 4 and 5, a pair of supporting parts 34*c* are formed in substantially symmetrical positions on the end surfaces of each U-shaped member on either side of the corresponding attachment ring 34*a*. These supporting parts 34*c* advance into the inside of the outer cutter holder 32 when the cutter retaining plate 34 is mounted inside the cutter frame 30, so that the tip ends of these supporting parts 34*c* contact the lower end surfaces of the outside outer cutters 76. Furthermore, there are no particular restrictions on the number of supporting parts 34*c* or the positions where these supporting parts 34*c* are formed.

Structure for Holding Inner Cutters by Cutter Retaining Plate

The structure by which the inner cutters 20 are held by the cutter retaining plate 34 will be described below.

First, each outside inner cutter base 88 which has an outside inner cutter 84 attached on the side of one end portion (i.e., the upper end in FIGS. 1 and 2) is inserted into the corresponding attachment ring 34*a* from the other end portion (i.e., the lower end in FIGS. 1 and 2), and the side of this other end portion is caused to protrude. In this case, the locking flange part 88*e* formed on the outer-circumferential surface of the other end portion of each outside inner cutter base 88 interferes with the anchoring members 48 that protrude from the inner-circumferential surface of the corresponding attachment ring 34*a*; however, the locking flange parts 88*e* are inserted into the attachment rings 34*a* by utilizing the fact that the synthetic resin anchoring portions 48 undergo elastic deformation and bend.

As a result, the locking flange parts 88*e* and fastening flange parts 88*a* of the outside inner cutter bases 88 are positioned so that the anchoring portions 48 will be clamped. Accordingly, as in the case of the conventional inner cutters 20 and inner cutter bases 22, the anchoring portions 48 engage with the locking flange parts 88*e* and fastening flange parts 88*a* when the outside inner cutter bases 88 move along the axial lines of the corresponding attachment rings 34*a*. Consequently, the outside inner cutter bases 88 are held by the cutter retaining plate 34 so that these cutter bases cannot slip out of the attachment rings 34*a*, and so that the cutter bases are tiltable and rotatable inside the attachment rings 34*a*.

Next, the inside inner cutters 82 attached to the inside inner cutter bases 86 are pushed into the base insertion holes 88*c* of the outside inner cutter bases 88 from the side of the bump portions 86*b* of the inside inner cutter bases 86 while causing elastic deformation of the locking parts 86*a* formed on the outer-circumferential surfaces of the inside inner cutter bases 86. As result, the inside inner cutters 82 are connected to and held by the outside inner cutter bases 88 so that the inside inner cutters 82 are rotatable and prevented from falling out of the base insertion holes 88*c* of the outside inner cutter bases 88. Furthermore, in this connected state, the inside inner cutters 82 are surrounded in substantially concentric manner by the outside inner cutters 84.

As a result of the above-described connecting structure, the inside inner cutters 82 are held together with the outside inner cutters 84 in the attachment rings 34*a* of the cutter retaining plate 34 so that the cutters are rotatable independently of each other, so that the axial lines of the cutters are tiltable independently in all directions with respect to the axial lines of the attachment rings 34*a*, and so that the cutters are movable independently along the axial lines of the attachment rings 34*a*.

Structure that Attach Outer Cutters and Inner Cutters to the Cutter Frame

The attachment structure by which the outer cutters 18 and inner cutters 20 are attached to the cutter frame 30 is substantially the same as that used in the conventional example. Specifically, the outer cutter holder 32 to which outer cutters 18 formed by integrally connecting the inside outer cutters 74 and outside outer cutters 76 are attached is first mounted in the cutter frame 30. Afterward, the cutter retaining plate 34 holding inner cutters 20 formed by integrally connecting inside inner cutters 82 and outside inner cutters 84 is attached to the cutter frame 30 using the attachment screw 50 over which the coil spring 53 has been fitted. As a result, the outer cutter holder 32 is pressed by the supporting frame 34*b* of the cutter retaining plate 34 as shown in FIG. 1. Furthermore, the outer cutters 18 (or more specifically the outside outer cutters 76) held by the outer cutter holder 32 are pressed by the supporting parts 34*c* that extend from the U-shaped members of the supporting frame 34*b*. The outer cutters 18 and inner cutters 20 are thus attached to the cutter frame 30 so that the cutters are prevented from falling out.

Furthermore, when the cutter retaining plate 34 is attached to the cutter frame 30, the columnar positioning engaged portions 86*c* formed on the inside inner cutter bases 86 enter and engage with the cylindrical positioning engaging portions 74*c* formed in the inside outer cutters 74. As a result, the axial lines of the inside outer cutters 74 and the inside inner cutters 82 constantly coincide. Also, the cylindrical tip end portions 88*b* of the outside inner cutter bases 88 enter and engage with the cylindrical portions 80*a* of the fastening ring members 80 of the outside outer cutters 76. Thus, the axial lines of the outside outer cutters 76 and the outside inner cutters 84 constantly coincide.

Moreover, in the above embodiment, the positioning engaged portions 86*c* are formed as columnar projections and the positioning engaging portions 74*c* are formed as cylindrical recesses. However, it is also possible to use a reverse structure. In other words, the positioning engaged portions 86*c* are formed as cylindrical recesses, the positioning engaging portions 74*c* are formed as columnar projections, and the positioning engaging portions 74*c* enter and engage with the positioning engaged portions 86*c*.

Furthermore, by turning the attachment screw 50 in the opposite direction, the inner cutters 20, as an integral unit with the cutter retaining plate 34, are removed from the cutter frame 30. Also, the outer cutters 18, as an integral unit with the outer cutter holder 32, are removed from the cutter frame 30.

Structure of Main Body Case

Next, the structure of the main body case 16 in which the inner cutter drive shafts 28 are disposed will be described.

The main body case 16 is formed from a synthetic resin material as a cylindrical body with an open top and closed bottom. A motor 12, battery (not shown) and control circuit, etc., are contained inside this main body case 16.

A gear bearing plate 58 is disposed inside the main body case 16 near the edge of the opening of the main body case 16. The motor 12 is fastened to this gear bearing plate 58 in a state in which the output shaft 12*a* of the motor 12 is caused to protrude. Furthermore, first supporting shafts 60 and second supporting shafts 90 are fastened in place adjacent to the output shaft 12*a* and parallel to the output shaft 12*a* in positions that are separated from each other.

The characterizing feature of the main body case 16 of the present embodiment is that so as to comply with the structures of the outer cutters 18 and inner cutters 20, the inner cutter driving gears 64 are constructed from respectively independent inside inner cutter driving gears (called "inside driving gears") 92 and outside inner cutter driving gears (called "outside driving gears") 94.

Furthermore, the inner cutter drive shafts 28 are also constructed from respectively independent inside inner cutter drive shafts (called "inside drive shafts") 96 and outside inner cutter drive shafts (called "outside drive shaft") 98.

Furthermore, a motor gear 62 is attached to the output shaft 12*a*. An inside driving gear 92, which rotates the corresponding inside inner cutter 82, and an outside driving gear 94, which is carried on the upper surface of this inside driving gear 92 and rotates the corresponding outside inner cutter 84, are attached to each first supporting shaft 60 so that these gears 92 and 94 are rotatable independently of each other.

Furthermore, a reverse rotation gear 100 is attached to each second supporting shaft 90 so that this gear is rotatable. The respective gears 62, 92, 94 and 100 are formed from a synthetic resin material.

Structures of Driving Gears

The structures of the inside driving gears 92 and outside driving gears 94 will be described in greater detail below, and the engagement relationships of the respective driving gears 92 and 94 with the motor gear 62 and reverse rotation gears 100 will be described.

The structure of each inside driving gear 92 is such that an inside columnar body 92*a* which extends coaxially with the axial line of the inside driving gear 92 is formed on the upper surface of the inside driving gear 92. A first supporting shaft hole 92*b* which opens in the undersurface of the inside driving gear 92 is formed coaxially with the axial line of the inside driving gear 92 inside this inside columnar body 92*a*. Furthermore, inner shaft anchoring portions 92*c* are caused to protrude from the outer-circumferential surface of the end portion of the inside columnar body 92*a* located on the side of the corresponding inner cutter 20 (i.e., the upper end portion in FIGS. 1 and 2).

The structure of each outside driving gear 94 is such that a connecting hole 94*a* into which the corresponding inside columnar body 92*a* can be inserted is formed coaxially with the inside columnar body 92*a* in the center of the outside driving gear 94. Outer shaft anchoring portions 70 are formed on the upper surface of each outside driving gear 94 so that the anchoring portions 70 surround the connecting hole 94*a*. Moreover, as shown in FIG. 2, each of these outer shaft anchoring portions 70 is constructed from a protruding hook 70*a* and a guide piece 70*b* so as to protrude on concentric circles centered on the axial line of the outside driving gear 94. As seen from FIG. 2, four pairs of protruding hook 70*a* and guide piece 70*b* are formed. Furthermore, as one example, the diameter of the outer edge of each outside driving gear 94 on which the teeth are formed is set so that this diameter is larger than the diameter of the outer edge of each inside driving gear 92 on which the teeth are formed.

Figure 3:
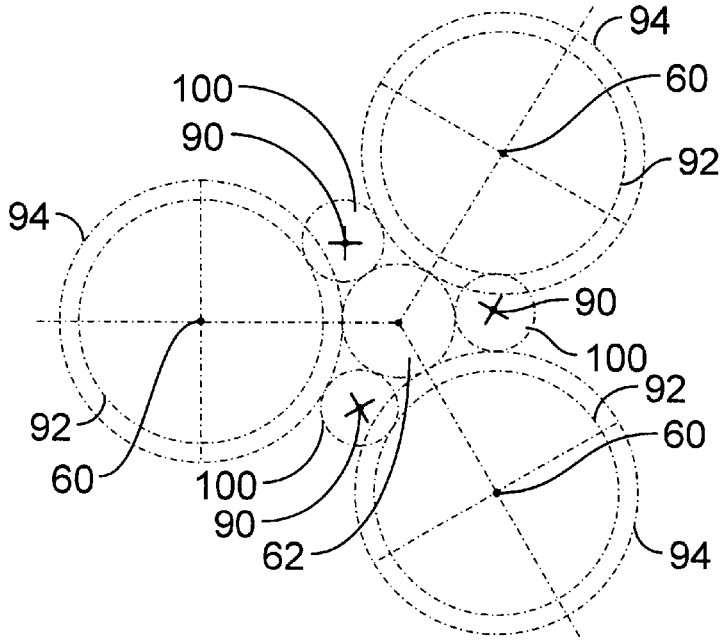
FIG. 3 is a plan view illustrating the relationship of the inside driving gears, outside driving gears, motor gear and reverse rotation gears.

Furthermore, as shown in FIG. 3, the motor gear 62 engages with the respective outside driving gears 94 and with the respective reverse rotation gears 100. Moreover, the respective inside driving gears 92 each engages with the corresponding reverse rotation gear 100.

As a result of this structure, the rotation of the motor gear 62 is transmitted directly to the respective outside driving gears 94, and is transmitted to the respective inside driving gears 92 via the respective reverse rotation gears 100. Furthermore, since one reverse rotation gear 100 is interposed between each inside driving gear 92 and the motor gear 62, the direction of rotation of the inside driving gears 92 is the opposite direction from the direction of rotation of the outside driving gears 94.

Here, the rpm values of the inside driving gears 92 and outside driving gears 94, i.e., the respective rpm values of the inside inner cutters 82 and outside inner cutters 84, can be adjusted by appropriately setting the numbers of teeth of the inside driving gears 92, outside driving gears 94 and reverse rotation gears 100. Furthermore, the respective peripheral speeds of the inside inner cutters 82 and outside inner cutters 84 can also naturally be adjusted. Accordingly, the rpm values and peripheral speeds of the respective inner cutters 82 and 84 can be set at optimal values by experiment or on the basis of experience, so that the shaving characteristics can be improved.

Structure of Inner Cutter Drive Shafts

Furthermore, a cutter cradle 26 is mounted in the opening part of the main body case 16 so that this cutter cradle 26 closes off this opening part. Drive shaft holes 66 are formed coaxially in this cutter cradle 26 in positions corresponding to the first supporting shafts 60 (i.e., in positioned directly above the first supporting shafts 60). Inner cutter drive shafts 28 are disposed so that the tip ends of these inner cutter drive shafts 28 protrude from these drive shaft holes 66.

The inner cutter drive shafts 28 transmits the rotational force of the motor 12 to the inner cutters 20. More specifically, each of the inner cutter drive shafts 28 is comprised of a cylindrical inside drive shaft 96 and a cylindrical outside drive shaft 98. The cylindrical inside drive shaft 96 rotates the corresponding inside inner cutter 82, and the cylindrical outside drive shaft 98 is disposed so as to surround the inside drive shaft 96 and rotates the corresponding outside inner cutter 84. These drive shafts 96 and 98 are formed from a synthetic resin material.

The structures of the respective drive shafts 96 and 98, and the connecting structures that connect these drive shafts with the respective driving gears 92 and 94 and the respective inner cutter bases 86 and 88, will be described in greater detail below.

Each inside drive shaft 96 is formed in a cylindrical shape. The end portion of the drive shaft 96 that faces the corresponding inner cutter 20 (i.e., the upper end portion in FIGS. 1 and 2) is closed off. A connecting recess 96*a* which is used to make a connection with the bump portion 86*b* of the corresponding inside inner cutter base 86 is formed in this closed-off end portion. Furthermore, as one example, two pairs of slits 96*b* that extend downward in the direction of the axial line are formed in the outer-circumferential surface of the inside drive shaft 96, and the region between each pair of slits 96*b* is formed as an elastically deformable tongue portion 96*c*. Furthermore, engaging slots 96*d* which extend in the axial direction are respectively formed in the two tongue portions 96*c*.

In the present embodiment, the connecting recess 96*a* is formed as a recess that allows the insertion of the bump portion 86*b* of the corresponding inside inner cutter base 86. The cross-sectional shape of the inner circumferential surface of the connecting recess in a plane that cuts across the part perpendicular to the axial line of the inside drive shaft 96 is a non-circular shape (as one example, a square shape in the present embodiment) that matches the cross-sectional shape of the bump portion 86*b* in the direction perpendicular to the direction of the axial line.

As a result, each inside inner cutter base 86 whose bump portion 86*b* is inserted into the corresponding connecting recess 96*a* rotates with the rotation of the corresponding inside drive shaft 96 when this inside drive shaft 96 rotates. The rotational force of the inside drive shaft 96 is then transmitted to the corresponding inside inner cutter 82. Furthermore, the diameter the portion of each inside inner cutter base 86 that is located above the bump portion 86*b* is effectively constricted so that this diameter is smaller than the diameter of the bump portion 86*b*. Moreover, the shape of the undersurface of the bump portion 86*b* that contacts the inside bottom surface of the corresponding connecting recess 96*a* is formed as a protruding curved surface. Accordingly, the inside inner cutter base 86 can tilt smoothly in all directions within a specified angular range relative to the axial line of the inside drive shaft 96 (with the bump portion 86*b* as a fulcrum). In this case, the opening edge portions of the connecting recess 96*a* do not interfere with the outer-circumferential surface of the inside inner cutter base 86.

Structures of Inner Cutter Driving Gears and Inner Cutter Drive Shafts

With an inside spring 102 accommodated inside the inside drive shaft 96, each inside drive shaft 96 is mounted on the inside columnar body 92*a* of the corresponding inside driving gear 92 that protrudes from the upper surface of the corresponding outside driving gear 94. In this case, inside drive shaft 96 is mounted on the inside columnar body 92*a* so that the inside drive shaft 96 covers the inside columnar body 92*a* from above. The spring 102 is, for example, a coil spring; but a plate spring, etc. may be used instead.

When the inside drive shaft 96 is set over the inside columnar body 92*a* of the corresponding inside drive gear 92, the lower ends of the tongue portions 96*c* formed in the inside drive shaft 96 tentatively contact the inner shaft anchoring portions 92*c* formed on the outer-circumferential surface of the tip end of the inside columnar body 92*a*. However, the tongue portions 96*c* undergo elastic deformation so that the inner shaft anchoring portions 92*c* enter the engaging slots 96*d*.

Then, after the inner shaft anchoring portions 92*c* have entered the engaging slots 96*d*, the inside drive shaft 96 is constantly driven in the direction that separates the inside drive shaft 96 from the inside columnar body 92*a* as a result of the driving force received from the compressed inside coil spring 102. However, since the inner shaft anchoring portions 92*c* are engaged with the lower inner-circumferential surfaces of the engaging slots 96*d*, the inside drive shaft 96 does not slip out of the inside columnar body 92*a*.

As a result, each inside drive shaft 96 is connected to the corresponding inside driving gear 92 so that the relative rotation of such two components is prevented and the inside drive shaft 96 rotates as a unit with the corresponding inside driving gear 92. Furthermore, the inside drive shaft 96 is movable in the direction of the axial line within a range equal to the length of the engaging slots 96*d*.

Accordingly, the inside inner cutter bases 86 connected to the inside drive shafts 96 and the inside inner cutters 82 attached to these inside inner cutter bases 86 can rotate as a unit with the inside driving gears 92.

Each outside drive shaft 98 is formed in a cylindrical shape. A plurality of outer base engaging parts 98*a* are formed on the upper end surface of the outside drive shaft 98 so that these outer base engaging parts 98*a* are lined up in the circumferential direction. In the shown embodiment, four outer base engaging parts 98*a* are provided. The outer base engaging parts 98*a* engage with the lower end portion of the corresponding outside inner cutter base 88. Furthermore, engaging projections 98*b* which engage with the outer shaft anchoring portions 70 formed on the corresponding outside drive shaft 94 are formed on the outer-circumferential surface of the lower end portion of the outside drive shaft 98. The engaging projections 98*b* are formed in the same number as the outer shaft anchoring portions 70.

Furthermore, each outside drive shaft 98 is fitted over the corresponding inside drive shaft 96 together with an outside coil spring 72 in a state in which this outside coil spring 72 is accommodated inside the outside drive shaft 98. In this case, the engaging projections 98*b* formed on the lower end portion of the outside drive shaft 98 enter the spaces between the protruding hooks 70*a* and guide pieces 70*b* forming the outer shaft anchoring portions 70, and engage with the protruding hooks 70*a*.

When the outside drive shaft 98 are fitted over the inside drive shafts 96, the lower ends of the outside coil springs 72 contact the upper surfaces of the outside driving gears 94, while the upper ends of these outside coil springs 72 contact step parts formed in the inner-circumferential surfaces of the outside drive shaft 98, so that the outside coil springs 72 are compressed.

As a result, the outside drive shaft 98 receive a driving force from the outside coil springs 72 that constantly drives the outside drive shaft 98 away from the outside driving gears 94. However, even in cases where the outside drive shaft 98 are moved upward along the guide pieces 70*b*, this upward movement is restricted. In other word, the upward movement of the outside drive shaft 98 is stopped when the engaging projections 98*b* formed on the outer-circumferential surface of the lower end portion engage with the protruding hooks 70*a* of the outer shaft anchoring portions 70. As a result, the outside drive shaft 98 are prevented from slipping off of the inside drive shafts 96.

As a result, the outside drive shaft 98 are connected to the outside driving gears 94 so that the relative rotation of these components is prevented, thus allowing the outside drive shaft 98 to rotate as a unit with the outside driving gears 94.

Accordingly, the outside inner cutter bases 88 connected to the outside drive shaft 98 and the outside inner cutters 84 attached to these outside inner cutter bases 88 can rotate as a unit with the outside driving gears 94.

Connecting Structure of Cutter Head Section and Main Body Case

As a result of the above-described structures of the cutter head section 24 and main body case 16, the bump portions 86*b* of the inside inner cutter bases 86 are connected to the connecting recesses 96*a* of the inside drive shafts 96 when the cutter head section 24 is attached to the main body case 16. Also, the lower end portions of the outside inner cutter bases 88 engage with the outer base engaging parts 98*a* formed on the outside drive shaft 98. Moreover, the inside drive shafts 96 are pushed toward the inside of the cutter cradle 26 by the inside inner cutter bases 86 against the driving force of the inside springs 102, and the outside drive shaft 98 are pushed toward the inside of the cutter cradle 26 by the inside inner cutter bases 86 against the driving force of the outside coil springs 72.

In this state, the driving force of the inside springs 102 is transmitted to the inside inner cutters 82 from the inside drive shafts 96 via the inside inner cutter bases 86. Thus, the inside inner cutters 82 are pushed toward the inside outer cutters 74 and make a tight contact with the inside surfaces of the inside hair introduction regions W of the inside outer cutters 74.

Furthermore, the driving force of the outside coil springs 72 is transmitted to the outside inner cutters 84 from the outside drive shaft 98 via the outside inner cutter bases 88. As a result, the outside inner cutters 84 are pushed toward the outside outer cutters 76 and make a tight contact with the inside surfaces of the outside hair introduction regions V of the outside outer cutters 76.

In addition, the respective outer cutters 74 and 76 are pushed by the respective inner cutters 82 and 84 so that the outer cutters 74 and 76 protrude to the maximum extent from the cutter frame 30.

As described above, the outside outer cutters 76 are pressed against the upper end of the outer cutter holder 32 by the supporting parts 34*c* formed on the supporting frame 34*b* of the cutter retaining plate 34 as shown in FIG. 5. As a result, when the outside outer cutters 76 contact the skin and are moved into the cutter frame 30, the outside outer cutters 76 are moved against the driving force of the outside coil springs 72 and of the coil spring 53 that is fitted over the attachment screw 50. In the meantime, the inside outer cutters 74 are moved only against the driving force of the inside springs 102.

Furthermore, when this electric shaver 110 is used to shave hair, the main body case 16 is held in the hand, and the outer cutters 18 that protrude from the surface of the cutter frame 30 are caused to contact the skin.

When the outer cutters 18 are not in contact with the skin, the axial lines of the outside outer cutters 76 (outside inner cutters 84) and the axial lines of the inside outer cutters 74 (inside inner cutters 82) are, together with the axial lines of the inside drive shafts 96 and the axial lines of the first supporting shafts 60, located on the axial lines of the outside drive shaft 98.

When, in order to shave hair, the outer cutters 18 are brought into contact with and pressed against the skin, an external force exceeding a specified value is applied to the outer cutters 18. When the external force is thus applied, in accordance with the contour of the skin, the outside outer cutters 76 are moved into the interior of the cutter frame 30 against the driving force of the outside coil springs 72 and coil spring 53. Also, in accordance with the contour of the skin, the outside outer cutters 76 tilt in all directions with respect to the axial lines of the outer cutter holes 42.

Furthermore, independently of the movements of the outside outer cutters 76 with respect to the cutter frame 30, the inside outer cutters 74 move into the interiors of the outside outer cutters 76 against the driving force of the inside springs 102, or tilt in all directions with respect to the axial lines of the outside outer cutters 76. When the external force from the skin is reduced, the inside outer cutters 74 and outside outer cutters 76 are returned to their original positions by the driving force of the inside springs 102, outside coil springs 72 and coil spring 53.

In other words, when hair is shaved, the axial lines of the inside drive shafts 96 do not tilt with respect to the axial lines of the first supporting shafts 60, since the inside drive shafts 96 are mounted by being fitted over the inside columnar bodies 92*a* of the inside driving gears 92. However, the axial lines of the outside outer cutters 76 (outside inner cutters 84), the axial lines of the inside outer cutters 74 (inside inner cutters 82) and the axial lines of the outside drive shaft 98 tilt appropriately with respect to the axial lines of the first supporting shafts 60 in accordance with the direction of the external force received from the skin by the outer cutters 18.

Accordingly, the shape of the contact surface between the outer cutters 18 and the skin varies according to the contour of the skin. More specifically, the positional relationship of the inside hair introduction regions W and outside hair introduction regions V formed at the contact surface between the outer cutters 18 and the skin varies. As a result, the respective inside hair introduction regions W and outside hair introduction regions V are put in tight contact with the skin in a flat attitude even if the contour of the skin should vary. This allows a great improvement in the shaving efficiency.

In the above embodiment, the inside inner cutters 82 and outside inner cutters 84 are constructed as independent components. Also, the driving systems for these components, i.e., the driving gears 92 and 94 and the inside drive shafts 96 and 98, are separately constructed for exclusive use with these respective cutters. Accordingly, the inside inner cutters 82 and outside inner cutters 84 can be caused to rotate in opposite directions by applying a rotational force to the inside driving gears 92 via the reverse rotation gears 100.

As a result, the user can obtain a shaving effect that differs from the shaving effect obtained in a case where the inside inner cutters 82 and outside inner cutters 84 both rotate in the same direction of rotation. In other words, since the respective inner cutters 82 and 84 are caused to rotate in opposite directions, hair can be efficiently shaved even in cases where hair growing in different directions from the skin are mixed together.

It is also possible to omit the reverse rotation gears 100 and to set the diameters of the respective driving gears 92 and 94 as the same diameter so that the gears can be caused to rotate in the same direction by driving these gears by the motor gear 62.

Furthermore, when the outer cutters 18 are not in contact with the skin, the respective amounts of protrusion of the contact surfaces of the inside outer cutters 74 and the contact surfaces of the outside outer cutters 76 from the surface of the cutter frame 30 is set to be the same. However, the inside outer cutters 74 can be set so as to protrude further than the outside outer cutters 76. In the structure in which the inside outer cutters 74 thus protrude, not only the corner areas on the outer-circumferential sides of the contact surfaces of the outside outer cutters 76 but also the corner areas on the outer-circumferential sides of the contact surfaces of the inside outer cutters 74 contact the skin easily. Accordingly, the hair can enter slits 40, which extend to the respective corner areas, more easily, and the shaving effect is improved.

Furthermore, it is advisable to set the driving force received by the inside outer cutters 74 from the inside inner cutters 82 stronger than the driving force received by the outside outer cutters 76 from the outside inner cutters 84 and by the cutter retaining plate 34. The reason for this is as follows: when the outer cutters 18 contact the skin, the inside outer cutters 74 and outside outer cutters 76 are independently moved into the interior of the cutter frame 30 as a result of the external force applied from the skin; by way of setting the driving force received by the inside outer cutters 74 stronger than the driving force received by the outside outer cutters 76, the inside outer cutters 74 protrude further than the outside outer cutters 76. As a result, the effect obtained by the structure in which the inside outer cutters 74 protrude further than the outside outer cutters 76 can be obtained.

In order to ensure that the driving force received by the inside outer cutters 74 from the inside inner cutters 82 is thus stronger than the driving force received by the outside outer cutters 76 from the outside inner cutters 84 and by the cutter retaining plate 34, it is necessary to set the strength of the driving force of the inside springs 102 greater than the combined strength of the driving force of the outside coil springs 72 and the driving force of the coil spring 53.

Furthermore, the structure in which the inside outer cutters 74 protrude further than the outside outer cutters 76 and the structure in which the driving force received by the inside outer cutters 74 from the inside inner cutters 82 is stronger than the driving force received by the outside outer cutters 76 from the outside inner cutters 84 and by the cutter retaining plate 34 can be combined. In this combined structure, the inside outer cutters 74 constantly protrude further than the outside outer cutters 76 even if the outer cutters are pressed somewhat strongly against the skin. As a result, the time for which hair is taken in from the corner areas of both outer cutters 74 and 76 is lengthened, thus greatly increasing the shaving effect. Accordingly, such a structure is more effective.

Furthermore, in the above-described embodiments, the hair discharge openings 89 are formed only in the outside inner cutter cutters 84. However, such hair discharge openings can be formed in the inside inner cutters 82 as well. It is also possible to form the hair discharge openings only in the inside inner cutters 82.

Figure 9A:
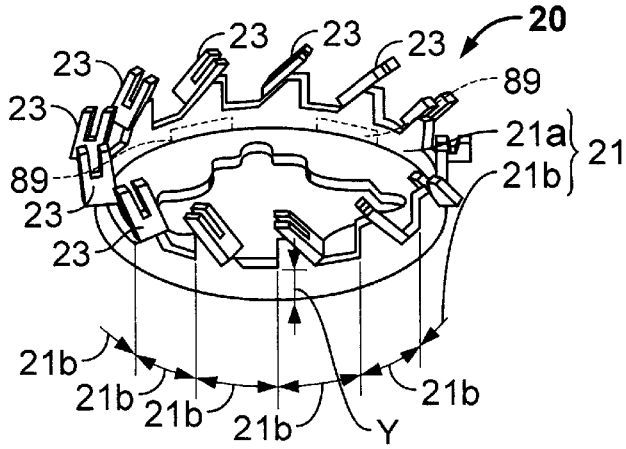
FIG. 9A PRIOR ART
FIG. 9A is a perspective view of the conventional inner cutter.
Figure 9B:
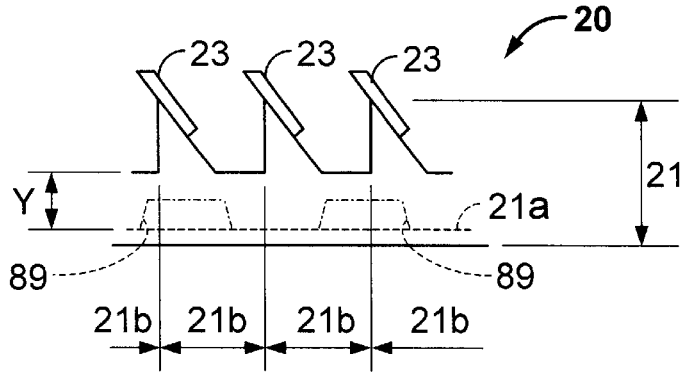
FIG. 9B PRIOR ART
FIG. 9B is a front view thereof.
Figure 9C:
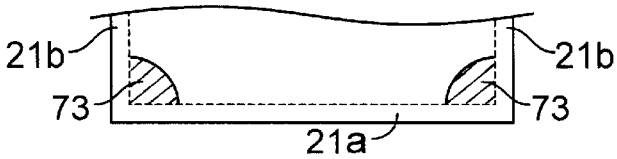
FIG. 9C PRIOR ART
FIG. 9C is a plan view thereof.

Furthermore, in the above embodiments, the respective outside upright supporting portions 87*b* are formed so that there are gaps between adjacent outside upright supporting portions 87*b*, and the adjacent outside upright supporting portions 87*b* are connected to each other by ribs 87*c* at positions away from the ring-form body 87*a*. The hair discharge openings 89 are thus formed by the ribs 87*c*, by the respective facing side surfaces of adjacent outside upright supporting portions 87*b* and by the upper surface of the ring-form body 87*a*. However, the structure used to form the hair discharge openings 89 is not limited to this structure. For instance, in the inner cutter 20 of the conventional example shown in FIG. 9B, openings can be formed (as indicated by the one-dot chain lines) in the root portions on the ring-form body (21*a*) side of the respective supporting upright bodies 21*b* connected to each other in a specified height range Y from the surface of the ring-form body 21*a* so that these holes are used as hair discharge openings 89.

Also, it is desirable that the hair discharge openings 89 are formed at equal angular intervals. However, such opening cannot be spaced at equal angular intervals. In this case, it is preferable that the hair discharge openings 89 open from the surface of the ring-form body 21*a* so that hair that have entered the interiors of the inner cutters 20 can easily be discharged to the outside is desirable.

In the above embodiments, even if the contour of the skin contacted by the outer cutters should vary, the outside outer cutters and inside outer cutters that form the outer cutters move independently. The respective contact surfaces of these respective outer cutters thus can both contact the skin more easily in a flat attitude. Accordingly, the hair shaving conditions are improved.

Furthermore, the inside inner cutters and outside inner cutters can be constructed as independent components, and the driving systems for these cutters can be also constructed as separate systems for exclusive use with the respective cutters. Then the inside inner cutters and outside inner cutters can be rotated in opposite directions by way of applying a rotational force to the inside driving gears via reverse rotation gears.

In view of the above, for the purpose of efficiently shaving the hair growing in different directions are mixed together, an electric shaver in which each of the inner cutters is constructed from two cutter elements, i.e., the outside inner cutter 84 and the inside inner cutter 82, is described. However, the present invention is not limited to an electric shaver of such a structure. It goes without saying that the present invention is applicable to an electric shaver in which each one of the inner cutters is constructed from a single cutter element as in the prior art shavers.

In other words, the present invention is applicable to an electric rotary shaver that comprises a main body case which contains an electric motor and a cutter head section which is detachably mounted on the main body case and has outer cutters and inner cutters that rotate while making sliding contact with the outer cutters and shave hair in cooperation with the outer cutters, wherein each of the inner cutters that is constructed from a single cutter element is formed with hair discharge openings. In this structure as well, it is difficult for hair to accumulate inside such inner cutters.

As seen from the above, according to the electric rotary shaver inner cutter and to the electric rotary shaver of the present invention, even if shaved hair should enter the interiors of the inner cutters, the shaved hair is discharged out of the inner cutters via the openings formed therein. Accordingly, the shaved hair is unlikely accumulate inside the inner cutters.

What is claimed is:

1. An inner cutter for an electric rotary shaver, the inner cutter comprising:

a cutter supporting member tat has a ring-form body formed in a shape of a flat plate and a plurality of upright supporting portions which rise from an outer-circumferential edge of the ring-form body and are lined up side by side; and an inner cutter body that is formed on a tip end of each one of the upright supporting portions, wherein the upright supporting portions are formed with gaps between adjacent upright supporting portions, and adjacent upright supporting portions are connected to each other by ribs at positions that are away from the ring-form body.

2. The inner cutter for an electric rotary shaver according to claim 1, wherein in each of the upright supporting portions, a width of a part of each upright supporting portion that is located on one side of a position where the ribs are joined and is closer to said ring-form body is smaller than a width of a part of each upright supporting portion located on another side of the position where the ribs are joined and is closer to the inner cutter body.

3. The inner cutter for an electric rotary shaver according to claim 2, wherein the inner cutter is formed by stamping and bending a single flat metal plate, and each of the ribs is bent outward from a central portion thereof so as to have a V shape.

4. The inner cutter for an electric rotary shaver according to claim 1, wherein the inner cutter is formed by stamping and bending a single flat metal plate, and each of the ribs is bent outward from a central portion thereof so as to have a V shape.

5. An electric rotary shaver comprising (a) a main body case that contains an electric motor, and (b) a cutter head section that is detachably mounted on an upper portion of the main body case, the cutter head section including outer cutters and inner cutters that shave hair in cooperation with the outer cutters while rotating in sliding contact with the outer enters, wherein (c) each of the inner cutters is comprised of:

a cutter supporting member that has a ring-form body formed in a shape of a flat plate and a plurality of upright supporting portions which rise from an outer-circumferential edge of the ring-form body and are lined up side by side; and an inner cutter body that is formed on a tip end of each one of the upright supporting portions, wherein the upright supporting portions are formed wit gaps between adjacent upright supporting portions, and adjacent upright supporting portions are connected to each other by ribs at positions that are away from the ring-form body.

6. The electric rotary shaver according to claim 5, wherein in each of the upright supporting portions, a width of a part of each upright supporting portion that is located on one side of a position where the ribs are joined and is closer to said ring-form body is smaller than a width of a part of each upright supporting portion located on another side of the position where the ribs are joined and is closer to the inner cutter body.

7. The electric rotary shaver according to claim 6, wherein the inner cutter is formed by stamping and bending a single flat metal plate, and each of the ribs is bent outward from a central portion thereof so as to have a V shape.

8. The electric rotary shaver according to claim 5, wherein the inner cutter is formed by stamping and bending a single fiat metal plate, and each of the ribs is bent outward from a central portion thereof so as to have a V shape.

9. An electric rotary shaver comprising:

(a) inside outer cutters;

(b) cylindrical outside outer cutters which surround the inside outer cutters in a concentric configuration, the cylindrical outside outer cutters being mounted inside a cutter frame so that tip ends of the outside outer cutters protrude together with the inside outer cutters from outer cutter holes Conned in the cutter frame;

(c) inside inner cutters tat make a sliding contact with the inside outer cutters; and (d) outside inner cutters that make a sliding contact with the outside outer cutters, wherein (e) each of the outside inner cutters is comprised of:

a cutter supporting member tat has a ring-form body formed in a shape of a flat plate and a plurality of upright supporting portions which rise from an outer-circumferential edge of the ring-form body and are lined up side by side, and an inner cutter body that is formed on a tip end of each one of the upright supporting portions, wherein the upright supporting portions are formed with gaps between adjacent upright supporting portions, and adjacent upright supporting portions are connected to each other by ribs at positions that are away from the ring-form body;

(f) the outside outer cutters are provided inside the cutter frame so that the outside outer cutters are tiltable with respect to axial lines of the outer cutter holes and movable along the axial lists, and the inside outer cutters are connected to the outside outer cutters so that the inside outer cutters are tiltable with respect to axial lines of the outside outer cutters and movable along tire axial lines;

(g) the inside inner cutters are engaged with the inside outer cutters so that the inside inner cutters are rotatable in a state in which the axial lines of the inside inner cutters and the inside outer cutters constantly coincide; and (h) the outside inner cutters are engaged with the outside outer cutters so that the outside inner cutters are rotatable in a state in which the axial lines of both cutters constantly coincide.

10. The electric rotary shaver according to claim 9, wherein in each of the upright supporting portions, a width of a part of each upright supporting portion that is located on one side of a position where the ribs are joined and is closer to said ring-form body is smaller than a width of a part of each upright supporting portion located on another side of the position where the ribs are joined and is closer to the inner cutter body.

11. The electric rotary shaver according to claim 10, wherein each of the inside inner cutters is famed by stamping and bending a single flat metal plate, and each of the ribs is bent outward from a central portion thereof so as to have a V shape.

12. The electric rotary shaver according to claim 9, wherein each of the inside inner cutters is formed by stamping and bending a singe flat metal plates, and each of the ribs is bent outward from a central portion thereof so as to have a V shape.

* * * * *